US006321840B1

(12) United States Patent
Billiter et al.

(10) Patent No.: US 6,321,840 B1
(45) Date of Patent: Nov. 27, 2001

(54) RESERVOIR PRODUCTION METHOD

(75) Inventors: Travis C. Billiter, Stafford; Anil K. Dandona, Sugarland, both of TX (US)

(73) Assignee: Texaco, Inc., White Plains, NY (US)

( * ) Notice: Subject to any disclaimer, the term of this patent is extended or adjusted under 35 U.S.C. 154(b) by 0 days.

(21) Appl. No.: 09/266,191

(22) Filed: Mar. 10, 1999

Related U.S. Application Data

(60) Provisional application No. 60/098,048, filed on Aug. 26, 1988.

(51) Int. Cl.[7] ..... E21B 43/16
(52) U.S. Cl. ..... 166/268; 166/274
(58) Field of Search ..... 166/268, 274

(56) References Cited

U.S. PATENT DOCUMENTS

| | | | | |
|---|---|---|---|---|
| 1,899,497 | * | 2/1933 | Doherty | 166/268 |
| 3,788,398 | * | 1/1974 | Shephard | 166/269 |
| 4,022,278 | * | 5/1977 | Allen | 166/269 |
| 4,199,028 | * | 4/1980 | Caughey | 166/314 |
| 4,393,936 | * | 7/1983 | Josendal | 166/263 |
| 4,598,770 | * | 7/1986 | Shu et al. | 166/245 |
| 4,628,999 | * | 12/1986 | Kiss et al. | 166/274 |
| 4,676,313 | * | 6/1987 | Rinaldi | 166/252 |
| 4,679,627 | * | 7/1987 | Harrison | 166/249 |
| 4,977,959 | * | 12/1990 | Combe | 166/274 |
| 5,267,615 | * | 12/1993 | Christiansen et al. | 166/273 |
| 5,720,350 | | 2/1998 | McGuire | 166/305.1 |

OTHER PUBLICATIONS

Article entitled "Gas Cap Blowdown of the Virginia Hills Belloy Reservoir," by F. C. Kuppe, et al., *The Petroleum Society*, Paper 98–34, Jun. 8–10, 1998, pp. 1–17.

Article entitled "Down–Dip Waterflooding of Oil Reservoir Having a Gas Cap," by A. K. Dandona, et al., *Journal of Petroleum Technology*, Aug. 1975, pp. 1005–1016.

Article entitled "Efficiency of Gas Displacement from a Water–Drive Reservoir," by D. C. Crowell, et al., U.S. Dept. of the Interior, Bureau of Mines, Investigation 6735, pp. 1–29.

Article entitled "Efficiency of Gas Displacement From Porus Media by Liquid Flooding," by T. M. Greffen, et al., *Petroleum Transaction*, vol. 195, 1952, pp. 29–38.

Article entitled "Experimental Research on Gas Saturation Behind the Water Front in Gas Reservoirs Subjected to Water Drive," by G. L. Chierici, et al., Section II–Paper 17–PD6 (Italy), Jun. 19–26, 1963, pp. 1–14.

Article entitled Experimental Studies on the Waterflood Residual Gas Saturation and Its Production by Blowdown, by T. P. Fishlock, et al., *Soc. Of Petroleum Engineers*, SPE 15455,.

Bleakley, "A Look at Adena Today," *The Oil and Gas Journal*, 83–85, Apr. 18, 1966.

Werovsky et al., "Case History of Algyo Field, Hungary," paper SPE 20995 presented at SPE Europe 90, The Hague, Netherlands, Oct. 22–24, 1990.

Deboni and Field, "Design of a Waterflood Adjacent to a Gas–Oil Contact," preprint paper SPE 5085 presented at the 1974 SPE Annual Meeting, Houston, Texas, Oct. 6–9, 1974.

Ader et al., "Gas Cap Water Injection Enhances Waterflood Process to Improve Oil Recovery in Badri Kareem Field," paper SPE 37756 presented at 1997 SPE Middle East Oil Show, Bahrain, Mar. 15–18, 1997.

* cited by examiner

*Primary Examiner*—Hoang Dang
(74) *Attorney, Agent, or Firm*—Morris N.. Reinisch; Howrey Simon Arnold & White

(57) ABSTRACT

A method of producing an oil reservoir having a gas cap and an oil column. A first injection fluid, such as water, is introduced into the reservoir at the gas-oil contact and gas and oil are simultaneously produced from the gas cap and oil column, respectively. A second injection fluid, such as water, may be introduced at a point in or below the oil column.

32 Claims, 15 Drawing Sheets

Variable Sand/Shale Model

Layered Sand/Shale Model

RESERVOIR PRODUCTION METHOD

The present application claims priority on U.S. Provisional Patent Application Ser. No. 60/098,048 filed Aug. 26, 1998. The entire text of each of the above-referenced disclosure is specifically incorporated by reference herein without disclaimer.

BACKGROUND OF THE INVENTION

1. Field of the Invention

This invention relates generally to oil production and, more specifically, to methods of producing oil reservoirs having a gas cap. In particular, this invention relates to simultaneous production of the gas cap and oil column while introducing an injection fluid at the gas-oil contact.

2. Description of Related Art

The conventional way of producing most oil reservoirs having a gascap is to attempt to produce only from the oil column while keeping the gascap in place so that it expands to provide pressure or energy support. Depending upon the geometry, reservoir dip angle, and oil production rates, gas may either cone down to the oil production wells and/or may breakthrough as a front, leading to substantial increases in the gas-oil ratio of the oil production wells. Direct production from the gas cap is typically delayed until such time that the oil zone is depleted, which may be many years after oil production is initiated. At such time, the gascap is usually directly produced or "blown down."

SUMMARY OF THE INVENTION

Disclosed is a method of simultaneously producing the gascap and oil column of an oil-productive reservoir, while at the same time introducing an injection fluid (such as water) at the reservoir gas-oil contact to create a water barrier to separate or segregate the gascap from the oil column, as well as to provide pressure support. Using this method, production from the gas cap may be immediately realized (increasing net present value of production) with little or no reduction in the ultimate oil zone recovery over conventional production methods in which the oil column is produced first. Surprisingly, any reduction in gascap recovery due to entrapment of gas by water at higher reservoir pressures is typically more than offset by increased present value due to early gas sales. Furthermore, production problems associated with gas coning are typically minimized. This may be particularly advantageous where submersible pumps are employed.

The method may be employed with oil-productive reservoirs having a relatively low-dip angle, relatively large gascap, and a relatively low residual gas saturation to water. However, benefits may be realized in reservoirs having a variety of other dip angles, gas cap sizes and residual gas saturation to water values. Advantageously, recovery from a gas cap is typically minimally affected by heterogenities in the reservoir. Thus, significance of early gas production becomes even greater in those cases where reservoir heterogenities adversely affect oil recovery efficiencies.

In one respect this invention is a method of producing fluids from a subterranean formation having a gas cap, an oil column, and a gas-oil contact therebetween, including introducing a first injection fluid into the formation at a first location adjacent the gas-oil contact; and producing gas and oil from the subterranean formation by simultaneously producing gas from a second location in the gas cap and producing oil from a third location in the oil column. The first injection fluid may be introduced at the first location through a wellbore penetrating the subterranean formation, with an angle of deviation at the subterranean formation of greater than about 75 degrees with respect to the vertical. The first injection may be introduced at a flow rate effective to overcome gradient segregation of the oil and the water so that the water moves upward into the gas cap. The gas may be produced from the second location and the oil is produced from the third location through wellbores penetrating the subterranean formation at each location with an angle of deviation at the subterranean formation of greater than about 75 degrees with respect to the vertical.

The first injection fluid may be introduced at a flow rate sufficient so that the first injection fluid moves upward into the gas cap. For example, the first injection fluid may be water or other aqueous-based fluid, and may be introduced at a flow rate effective to overcome gradient segregation of the oil and the first injection fluid so that the first injection fluid moves upward into the gas cap. The first injection fluid may be introduced into the formation at a flow rate effective to substantially separate the gas in the gas cap from the oil in the oil column in an area of the formation adjacent the first location where the first injection fluid is introduced. The first injection fluid may be introduced into the formation at the first location and displace oil downdip toward the third location.

The subterranean formation may have an average angle of formation dip less than or equal to about 45 degrees, alternatively less than or equal to about 20 degrees, alternatively less than or equal to about 15 degrees, alternatively less than or equal to about 10 degrees, alternatively from about 20 degrees to about 1 degree, alternatively from about 15 degrees to about 1 degree, alternatively from about 10 degrees to about 1 degree, alternatively from about 10 degrees to about 2 degrees from the horizontal at the location of the gas-oil contact.

The first injection fluid may be introduced at a flow rate effective to maintain the reservoir pressure at a substantially constant value in at least a drainage area defined between the first location and the second and third locations during production of gas and oil from the subterranean formation from the respective second and third locations. The first injection fluid may be at least one of an aqueous-based liquid, a gas that is liquid under conditions of reservoir temperature and pressure, or a mixture thereof. The first injection fluid may be introduced at a flow rate effective to prevent or substantially reduce migration of the gas in the gas cap downdip in the subterranean formation in an area adjacent the first location in the subterranean formation. The oil may be produced from the third location using a submersible pump. A second injection fluid may be introduced into the subterranean formation at a fourth location in the oil column, the fourth location being positioned within the oil column. The second injection fluid may be an aqueous based fluid, a gas, a gas that is liquid under conditions of reservoir pressure and temperature, or a mixture thereof. The gas-oil ratio of the oil produced at the third location may be maintained at a value about equivalent to the solution gas-oil ratio of the oil in the oil column. The reservoir voidage rate from a production of reservoir fluids from the subterranean formation may be substantially balanced by the introduction rate of the first and second injection fluids into the subterranean formation. In this regard "reservoir fluids" means any fluids (whether native or introduced into the reservoir from an outside source) produced from the reservoir.

The majority of the upper surface area of the oil column may not be in contact with the gas cap. The subterranean formation may have an angle of dip of less than or equal to about 10 degrees from the horizontal. The first injection fluid may have a viscosity greater than the viscosity of the gas in the gas cap. A pressure drop in the subterranean formation between the second point and the first point may be high enough so that viscous forces acting on the first injection fluid are sufficient to overcome gravitational forces acting on the injection fluid so that the first injection fluid moves within the subterranean formation in a direction toward the second point in the subterranean formation. The first injection fluid introduced into the subterranean formation at the first location may form a fluid barrier at the gas-oil contact, the fluid barrier separating the oil from the gas over at least a portion of the area of the gas-oil contact. A gas-fluid barrier contact and a oil-fluid barrier contact may be defined at the respective interfaces between the fluid barrier and the gas cap and the fluid barrier and the oil column; and the gas-fluid barrier contact may move in a direction updip in the subterranean formation, and the oil-fluid barrier contact may move in a direction downdip in the subterranean formation.

In another respect, this invention is a method of producing an oil reservoir having a gas cap, an oil column, and a gas-oil contact therebetween, including introducing a first injection fluid into the reservoir at or adjacent to the gas-oil contact of the reservoir; and producing gas and oil from the reservoir by simultaneously producing gas from the gas cap and producing oil from the oil column. The first injection fluid may be introduced through at least one deviated wellbore penetrating the reservoir at a location of the gas-oil contact; the gas may be produced from the gas cap through at least one second deviated well bore penetrating the reservoir at a location of the gas cap; and the oil may be produced from the oil column through at least one third deviated wellbore penetrating the reservoir at a location of the oil column; with each of the respective deviated wellbores having an angle of deviation, typically the angle of deviation being from about 30 degrees to about 90 degrees at the reservoir formation depth.

The first injection fluid may form a barrier which substantially separates the gas cap from the oil column; and withdrawal of gas from the gas cap may create a pressure gradient from the barrier toward the gas cap, the pressure gradient creating a viscous force acting on the barrier that is sufficient to overcome gravitational and displacement forces acting on the barrier so that the barrier moves into the gas cap. A displacement gradient required for the aqueous fluid to displace oil in the oil column may be greater than a displacement gradient required for the aqueous fluid to displace gas in the gas cap. The barrier may simultaneously move into the gas cap and the oil column, and the barrier may displace gas into the gas cap and displace oil into the oil column.

The reservoir may be a closed reservoir substantially isolated from water influx. The reservoir may further include a water column beneath the oil column, wherein the water column supplies at least a partial water drive to the reservoir. A volumetric withdrawal rate of fluid from the reservoir measured at reservoir conditions may be substantially equal to a volumetric introduction rate of fluid into the reservoir measured at reservoir conditions. A second injection fluid may be further introduced at a reservoir subsea depth that is substantially equal to or downdip of the depth at which the oil is produced from the reservoir. The second injection fluid may be introduced into or beneath the oil column. With the oil column underlying the gas cap, the second injection fluid may be introduced into the reservoir in a peripherally spaced manner. The first injection fluid may be at least one of an aqueous-based liquid, a gas that is liquid under conditions of reservoir temperature and pressure, or a mixture thereof. The second injection fluid may be an aqueous based fluid, a gas, a gas that is liquid under conditions of reservoir pressure and temperature, or a mixture thereof. Reservoir voidage rate from production of reservoir fluids may be substantially balanced by the introduction rate of the first and second injection fluids into the reservoir.

The majority of an upper surface area of the oil column may not be in contact with a lower surface of the gas cap. The reservoir may include a subterranean formation having an average angle of formation dip less than or equal to about 45 degrees from the horizontal at the location of the gas-oil contact in the reservoir. The first injection fluid may form a fluid barrier in contact with at least a portion of the gas-oil contact, the fluid barrier separating the oil column from the gas cap over at least a portion of the area of the gas-oil contact. The reservoir may include a subterranean formation having an angle of dip at the gas-oil contact, a gas-fluid barrier contact and a oil-fluid barrier contact defined respectively at the interfaces between the gas cap and the fluid barrier and between the fluid barrier and the oil column; and introduction of the first injection fluid may be effective to cause the gas-fluid barrier contact to move updip in the subterranean formation, and to cause the oil-fluid barrier contact to move downdip in the subterranean formation. The reservoir may be substantially isolated from water influx, and the average reservoir pressure of the formation may be maintained at a pressure above the bubble point of the oil column in the reservoir.

The first injection fluid may be introduced and displaced into the gas cap to a location of at least one deviated wellbore penetrating the reservoir at the gas cap; production from the at least one deviated wellbore penetrating the reservoir at the gas cap may be ceased when the first injection fluid reaches a location of the at least one deviated wellbore penetrating the reservoir at the gas cap; introduction of the first injection fluid may be continued into the at least one deviated wellbore penetrating the reservoir at the gas-oil contact so that the first injection fluid is displaced into the oil column to a location of the at least one deviated wellbore penetrating the reservoir at the oil column; and production from the at least one deviated wellbore penetrating the reservoir at the oil column may be continued. In any case, production from the oil column may be ceased and the gas cap blown down after the oil from the oil column is substantially depleted. Furthermore, in any case, production of gas from the gas cap may be ceased after producing the first injection fluid from the gas cap.

DESCRIPTION OF ILLUSTRATIVE EMBODIMENTS

Figure 1:
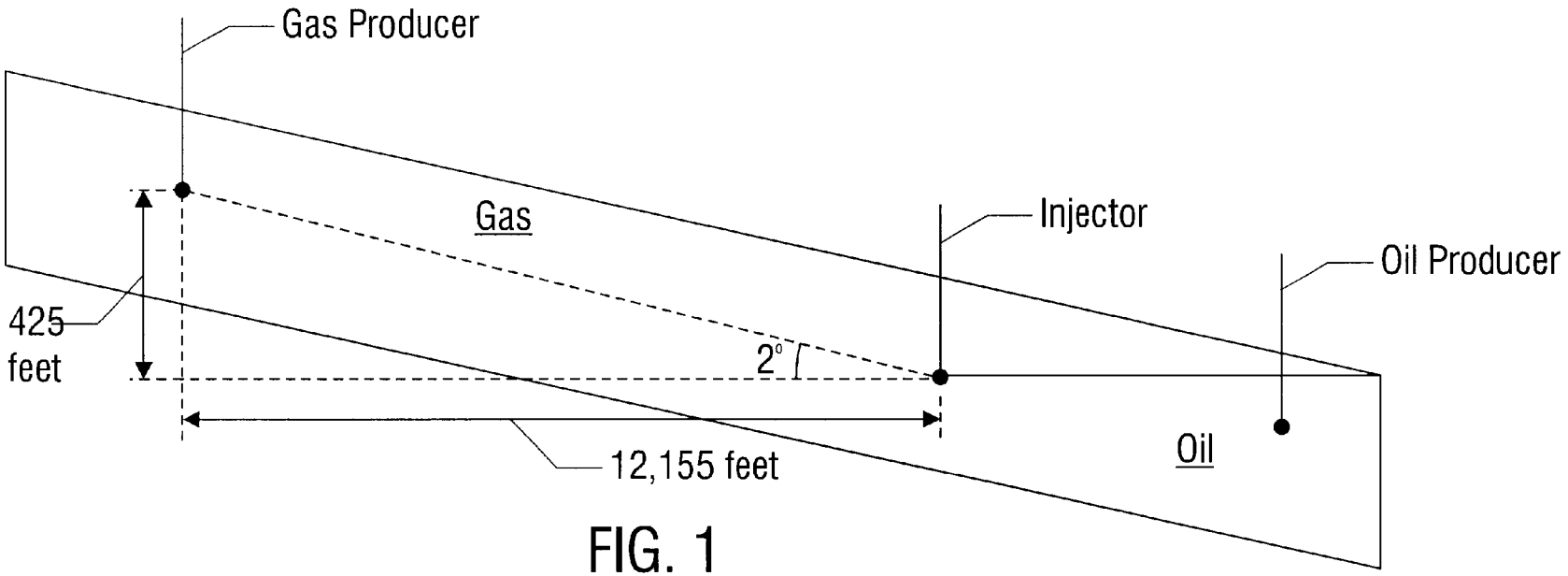
FIG. 1 is a simplified cross-sectional representation of a simulated reservoir having a gas cap, oil column, gas cap producer, and injection well located at the gas-oil contact.

Using the disclosed method, an injection fluid (such as water), may be introduced at the gas-oil contact of an oil-productive reservoir having an oil column overlain by a gas cap. Gas and oil are simultaneously produced from the gascap and oil column, respectively. When a sufficiently large enough pressure drop is created between the introduction point of the first injection fluid and the area of gas cap production, the first injection fluid will tend to move up dip into the gas cap due to viscous forces (caused by the pressure drop acting on the first injection fluid) that are greater than opposing gravitational forces (force acting on the first injection fluid).

Advantageously, an injection fluid may be introduced at flow rates high enough to overcome gravitational effects, so that a "front" of injection fluid is created that serves as a wall separating the gas and oil, and that acts to displace gas up structure and oil down structure. For optimal recovery, injection fluid introduction rates are also typically high enough to substantially replace the voidage caused by production of reservoir fluids, although this is not necessary to obtain benefit from the disclosed method. With regard to fluid introduction rates sufficient to overcome gravitational forces and/or to replace voidage, it will be understood by those of skill in the art with benefit of this disclosure that reservoir variables, such as reservoir dip and permeability, may dictate both optimal and achievable fluid introduction rates, as well as enhancement of hydrocarbon production rates and cumulative recoveries. Reservoir variables may also dictate the number and/or placement of production and injection wells. With benefit of the present disclosure and with knowledge of reservoir and/or reservoir fluid variables, a given reservoir may be evaluated for applicability and implementation of the disclosed method using known reservoir engineering techniques, for example, such as the reservoir simulation method employed in the examples given herein.

In the practice of the disclosed method, injection fluids may be introduced into, and production fluids may be withdrawn from, a reservoir through any well configuration known to those of skill in the art. In this regard, benefits of the disclosed method may be realized, for example, using vertical wells, horizontal wells, or deviated wells having an angle of deviation of between about 0° and about 90° with respect to the vertical at the formation penetration depth. In one embodiment, horizontal wells or deviated wells having an angle of deviation with respect to the vertical of from about 30° to about 90° at the formation depth, and alternatively from about 75° to about 90° at the formation penetration depth are employed, particularly with respect to wells used for introduction of a first injection fluid at the gas-oil contact. It will also be understood with benefit of this disclosure that wellbores having an angle of deviation greater than about 90° at the formation penetration depth may also be employed.

Use of horizontal or deviated wellbores typically increases the length and surface area of contact between a wellbore and the desired portion of the formation (e.g., the gas-oil contact, etc.). It will be understood by those of skill in the art with benefit of this disclosure that increased surface area contact between an injection wellbore and the formation is desirable to enhance the aereal extent of fluid injection. Thus, introduction of a first injection fluid through a wellbore that is oriented to pass through or across a gas-oil contact at a horizontal or deviated angle typically serves to enhance the aereal extent of the first injection fluid barrier created between the gas cap and the oil column. This is particularly true when the horizontal wellbore is oriented to pass substantially horizontally, or at an angle substantially parallel to, the angle of the gas-oil contact interface at this location. It will also be understood with benefit of this disclosure that a horizontal or deviated wellbore may be drilled and oriented with a well plan that follows the aereal contours of a gas-oil contact to further enhance the aereal extent of the barrier created between the gas cap and oil column. Although it is typically desirable that a first injection fluid be introduced into a reservoir through a wellbore that penetrates the gas-oil contact, it is only necessary that a first injection fluid be introduced through a wellbore sufficiently near or adjacent to such a gas-oil contact so as to allow the first injection fluid to migrate or otherwise move within the formation to form a barrier (as described elsewhere herein) between the gas cap and the oil column.

Oil production wells also typically have horizontal or deviated wellbores, and may be positioned at one or more desired locations within the oil column, typically at a location/s down dip of the gas-oil content. In this regard, oil column producers are typically positioned far enough downdip from the gas-oil contact to minimize tendency of gas coning from the gas cap and far enough updip from any water-oil contact that may exist to minimize water coning, although this is not necessary. A gas cap production well/s is also typically a horizontal or deviated well, and is typically positioned at a location as much updip of the gas-oil contact as possible, in order to maximize ultimate gas recovery as injection fluids move into the gas cap.

Although horizontal or deviated wellbores are typically employed at the locations described above, it will be understood with benefit of this disclosure that vertical wellbores and combinations of vertical, deviated and/or horizontal wellbores may also be successfully employed for the introduction of injection fluids and/or the withdrawal of production fluids. Furthermore, benefits of the disclosed method may be obtained with as few or as many introduction and/or production wells as desired, as long as least one first injection fluid introduction well, at least one oil column production well, and at least one gas cap production well are present.

A first injection fluid is typically introduced at, or adjacent to, the gas-oil contact of an oil-productive reservoir having an oil column and gas cap. As used herein, "first injection fluid" means any fluid that exists in liquid form under reservoir conditions of temperature and pressure. With benefit of this disclosure, those of skill in the art will understand that suitable first injection fluids may include, but are not limited to, aqueous fluids such as fresh water, sea water, brine, simulated brines (KCl water, etc.); natural and/or synthetic polymer-containing liquids (such as polysaccharide or polyacrylamide-containing aqueous liquids); miscible fluids (such as $CO_2$, etc.) or mixtures thereof.

In one embodiment, a first injection fluid that is water or another suitable aqueous liquid is injected at the gas-oil contact while gas and oil is simultaneously produced from production wells completed in the gas cap and oil column, respectively. Water is typically injected at the gas-oil contact at rates high enough to overcome gravity or hydrostatic effects so that the water moves up dip into the gas cap, displacing gas. During injection, water also tends to move down dip into the oil column displacing oil to the oil producers in the oil column. As used herein "dip" refers to the angle of a formation relative to the horizontal, "up dip" refers to a direction or location in the formation that is higher in structure (or shallower in depth), and "down dip" refers to a direction or location in the formation that is lower in structure (or deeper in depth). With benefit of this disclosure, it will be understood by those of skill in the art that the dip of a formation may vary from one location to the next in a given reservoir, and that dip angle may be expressed in average terms.

The disclosed method may be employed to produce reservoirs having essentially any average formation dip angle at the location of the gas-oil contact that is suitable for allowing a first injection fluid introduced at the gas-oil contact to segregate an oil column from an adjacent gas cap. Such a dip angle may be essentially constant throughout the remainder of the formation, or may vary in other areas of the reservoir. In one embodiment the formation dip angle at the gas-oil contact is typically less than or equal to about 45 degrees from the horizontal, alternatively less than or equal to about 30 degrees from the horizontal, alternatively less than or equal to about 20 degrees from the horizontal, alternatively less than or equal to about 15 degrees from the horizontal, alternatively less than or equal to about 10 degrees from the horizontal, and alternatively less than or equal to about 5 degrees from the horizontal, alternatively less than or equal to about 2 degrees from the horizontal.

In another embodiment, the average formation dip angle at the gas-oil contact is from about 45 degrees to about 1 degree from the horizontal, alternatively from about 30 degrees to about 1 degree from the horizontal, alternatively from about 20 degrees to about 1 degree from the horizontal, alternatively from about 15 degrees to about 1 degree from the horizontal, alternatively from about 10 degrees to about 1 degree from the horizontal, alternatively from about 5 degrees to about 1 degree from the horizontal, and alternatively from about 2 degrees to about 1 degree from the horizontal.

In still another embodiment, the average formation dip angle at the gas-oil contact is from about 45 degrees to about 2 degrees from the horizontal, alternatively from about 30 degrees to about 2 degrees from the horizontal, alternatively from about 20 degrees to about 2 degrees from the horizontal, alternatively from about 10 degrees to about 2 degrees from the horizontal, alternatively from about 5 degrees to about 2 degrees from the horizontal, and alternatively about 2 degrees from the horizontal.

In addition to providing pressure support and displacing gas, the first injection fluid is typically introduced at a rate sufficient to create a "wall" or barrier of water that acts to substantially separate gascap and oil column regions of a reservoir. In the practice of the disclosed method, such a barrier need only be created in an area of the reservoir adjacent to the introduction point of the first injection fluid. With benefit of this disclosure those of skill in the art will understand that the aereal extent of such a barrier typically depends on reservoir characteristics, such as horizontal permeability ($K_H$), vertical permeability ($K_V$), reservoir heterogenities, etc. Advantageously, such a barrier may act to control downward migration (or coning) of the gascap into oil production wells. Furthermore, introduction of injection fluid is typically controlled to be sufficient to maintain reservoir pressure by balancing the reservoir voidage created by the production of gas and oil. With benefit of this disclosure, reservoir injection/voidage ratio may be monitored and controlled by adjusting production and injection rates from the reservoir using, for example, measurements of reservoir pressure reservoir engineering techniques know to those of skill in the art.

In one embodiment of the disclosed method reservoir pressure may be further maintained, and/or oil recovery further enhanced, by introducing a second injection fluid into the oil column. A second injection fluid may be any fluid (gas and/or liquid) suitable for injection into a subterranean formation, for example, for reservoir pressure maintenance and/or enhanced oil recovery. Suitable second injection fluids include, but are not limited to, those fluids described elsewhere herein as suitable for use as a first injection fluid. A second injection fluid may be introduced around the periphery (or outer aereal boundary) of the oil column to further support oil withdrawal rates. For example, a second injection fluid may be introduced at one or more locations in an oil column near an oil-water contact. In this way a "ring" of second injection fluid may be created using a well pattern suitable for sweeping fluids radially inward. However, with benefit of this disclosure those of skill in the art will understand that a second injection fluid may also be introduced at any other location in an oil column (including through interior injection wells located between oil production wells completed in the oil column).

Fluids may be produced from a reservoir using any fluid production method known to those of skill in the art, including natural flow (where applicable) or artificial lift. In this regard, suitable artificial lift methods include, but are not limited to, sucker rod pump, gas lift, jet pump, electric submersible pump ("ESP"), etc. Advantageously, introduction of the first injection fluid at the gas-oil contact may be used to create a barrier that minimizes gas production (or gas-liquid ratio) in production wells, thus reducing artificial lift problems and enhancing efficiency of artificial lift equipment, especially with respect to ESP and sucker rod pump equipment.

In the practice of the disclosed method, a first injection fluid is typically injected at sufficiently high enough flow rates to overcome both the gravity and gas displacement components acting against movement of the first injection fluid into the gas cap. It will be understood with benefit of this disclosure that reservoir evaluation techniques known to those of skill in the art including, but not limited to, reservoir models similar to that employed in the examples included herein, may be used to optimize well placement, production and fluid introduction rates, etc. for any given reservoir so as to increase recovery factors for oil and/or gas.

Figure 14:
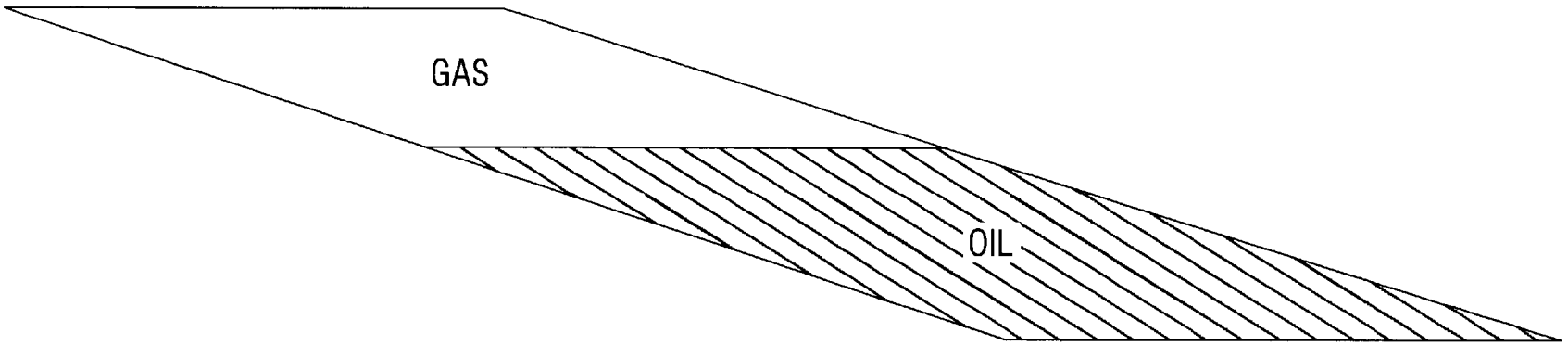
FIG. 14 is a simplified cross-sectional representation of a reservoir having a relatively low dip angle and in which the gascap does not overlie the entire oil column.

With benefit of this disclosure those of skill in the art will understand that, all things being equal, relatively smaller gas-oil contact surface area is typically desirable due to a corresponding decrease in minimum injection energy required to maintain a barrier between a gascap and oil column. For example, when the disclosed method is employed in the production of reservoirs where the gascap does not overlie the entire oil column, the surface area of the gas-oil contact is minimized, facilitating the injection of, for example, water at high enough rates to separate the gascap and oil column. Such a case is illustrated in FIG. 14, where a relatively low-dip reservoir is illustrated. However, it is not necessary that this condition be present. Furthermore, it will be understood that maximum introduction and/or production rates, as well as injection fluid barrier requirements and characteristics, may depend on many other factors including rock and fluid properties (such as individual reservoir permeability and thickness, fluid specific gravities, interfacial tension, etc.).

Typically, it is desirable to maintain reservoir pressure of an oil reservoir (such as at a pressure above the bubble point). However, it is also typically desirable to prevent entrapment of residual gas at higher pressures behind an encroaching front of first injection fluid. Therefore, it is often desirable to balance reservoir fluid withdrawal with reservoir fluid introduction to maintain pressure of the reservoir at a substantially constant value. However, this is not necessary and benefit of the disclosed method may be realized under conditions of varying reservoir pressure over the life of the project. A gas cap producer is typically shut-in once a front of first injection fluid encroaches upon the well. However, in such cases gas production may be extended by isolation and selective completion practices known to those of skill in the art.

Furthermore, it will be understood with benefit of this disclosure that although an essentially closed or isolated reservoir system is discussed herein, recovery from reservoirs having a water column and which have a partial or full water drive mechanism may also benefit from the disclosed method in which a gas cap is separated from an oil column by a first injection fluid barrier and in which the gas cap and oil column are simultaneously produced. Where partial or full aquifer support exists, desirable second injection fluid volumes are typically reduced from the volumes desirable for closed reservoirs. In a further embodiment of the disclosed method, a watered-out gas cap may be blowdown (rather than kept shut-in) after an oil column is substantially depleted in order to further increase total gas recovery from the gascap.

As used herein "substantially depleted" means that point at which it is no longer desirable to continue producing an oil column either on its own merits, or in view of deferred production from the watered-out gas cap. With benefit of this disclosure, those of skill in the art will understand that such a depleted condition may vary from well to well and field to field, and may be influenced by a number of factors. For example, an oil column may be substantially depleted when oil production reaches a physical limit at which no oil is produced from one or more wells producing from the oil column, or alternatively when oil production reaches an economic limit at which revenue from oil production is insufficient to cover operating costs, and/or when oil production reaches a level at which the present value of production from the watered-out gas cap exceeds the present value of continued oil production from the oil column.

Factors that favor the advantages observed in the use of the disclosed method to produce an oil reservoir include presence of a relatively large gascap, relatively low formation dip angle, presence of a relatively large oil column, and the existence of a low residual gas saturation to water. However, it will be understood with benefit of this disclosure that none of these factors need necessarily be present to obtain benefit form the practice of the disclosed method, and that reservoirs having other types of characteristics may also benefit. Furthermore, a wide variety of development strategies (including number and positioning of production and injection wells), may also be employed.

Just a few examples of suitable reservoir types include, but are not limited to, those described in Bleakley, W. B., "A Look at Adena Today," *The Oil and Gas Journal* pgs. 83–85, Apr. 18, 1966; Werovsky, V. et al., "Case History of Algyo Field, Hungary," paper SPE 20995 presented at SPE Europec 90, The Hague, Netherlands, October 22–24; Deboni W. and Field, M. B. "Design of a Waterflood Adjacent to a Gas-Oil Contact," preprint paper SPE 5085 presented at the 1974 SPE Annual Meeting, Houston, Tex., Oct. 6–9, 1974; and Ader, J. C. et al., "Gas Cap Water Injection Enhances Waterflood Process to Improve Oil Recovery in Badri Kareem Field," paper SPE 37756 presented at the 1997 SPE Middle East Oil Show, Bahrain, Mar. 15–18, 1997, which are incorporated herein by reference in their entirety. Examples of suitable reservoir types also include, but are not limited to, reservoirs having thin oil edge zones with large gascaps. All things else being equal, it should be noted that higher productivity formations (such as the relatively high permeability formation modeled in Example 1) may be expected to require a smaller number of producers and injectors than lower productivity fields (e.g., having a lower permeability formation), in order to achieve similar results. However, benefits of the disclosed method may be achieved in either case with a minimum of one gas cap producer, one gas-oil contact injector, and one oil column producer.

As shown in the examples disclosed herein, finite-difference simulation work indicates that the technique of the disclosed method may be implemented in a manner that causes little, if any, decrease in ultimate oil recovery. Under some conditions, ultimate gas recovery may be somewhat lower than that realized using conventional production methods due to residual gas being trapped by encroachment of injection fluid. However, from an income standpoint, such a decrease in ultimate gas recovery is typically more than offset by early and accelerated generation of income from gas sales.

EXAMPLES

The following examples are illustrative and should not be construed as limiting the scope of the invention or claims thereof.

In the following examples, a finite-difference simulator was used to evaluate different development strategies for an oil reservoir having a relatively large gascap, relatively low-dip angle, and relatively large oil column. In this Example, first and second injection fluids were selected to be water.

A simplistic representation of the simulated structure is shown in FIG. 1. This figure shows the location of the gas-oil contact, along with the location of the water injector at the gas-oil contact and of the gascap producer. The reservoir modeled in this study has a dip angle of 2°, however, for purposes of illustration the dip angle has been exaggerated in FIG. 1. It will be understood with benefit of this disclosure that the reservoir modeled represents only one example of a reservoir in which the disclosed method may be advantageously employed. In this regard, the disclosed method may be employed with reservoirs having other characteristics, including varying dip angle, distances between wells, number of wells, placement of wells, etc.

Figure 15:
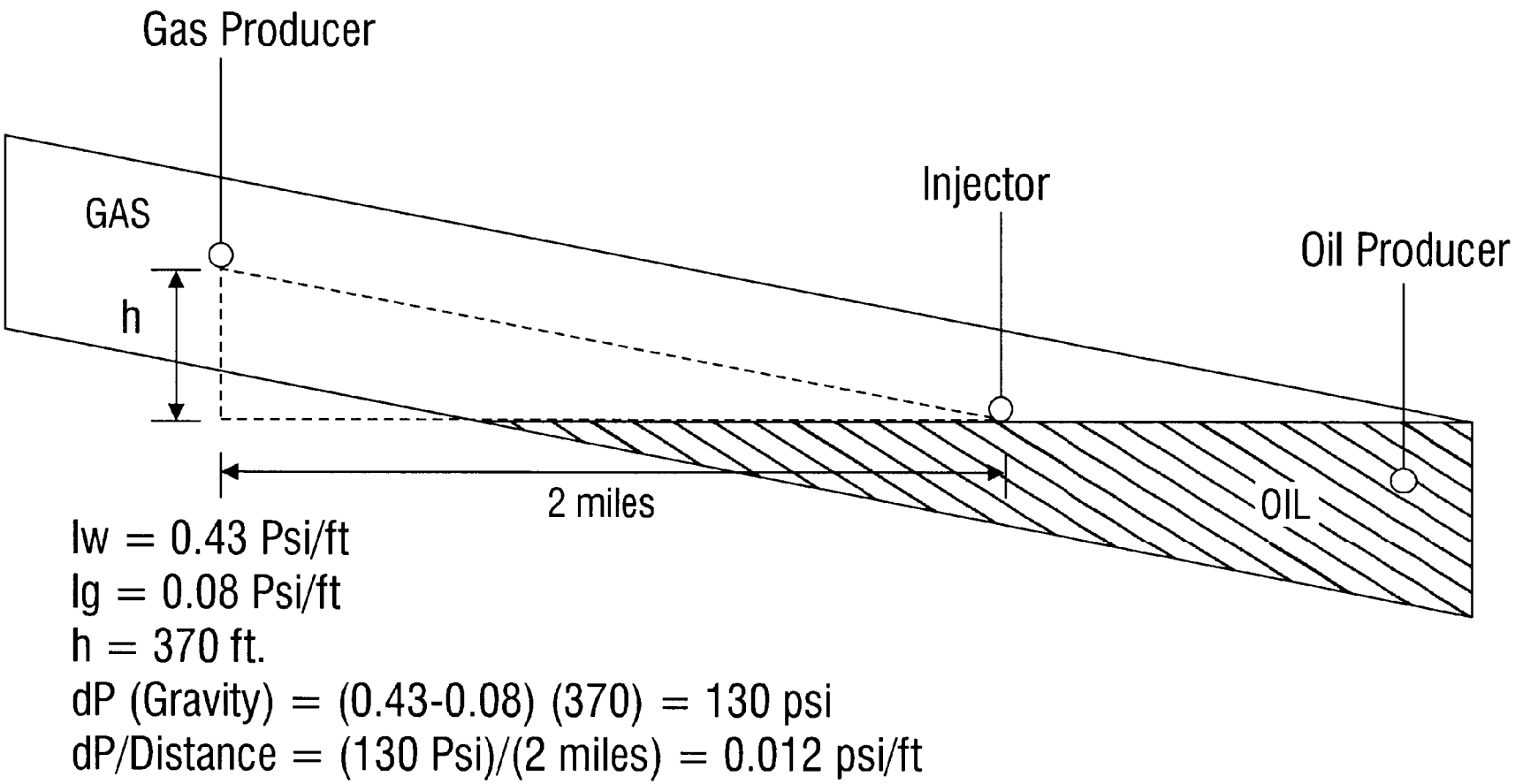
FIG. 15 is a simplified cross-sectional representation of a reservoir having a gas cap, oil column, gas cap producer, and injection well located at the gas-oil contact.

Still referring to FIG. 1, using representative values for a water gradient, 0.43 psi/ft, and for a gas gradient, 0.08 psi/ft, the calculated pressure differential required for the water to overcome the effects of gravity is 149 psi. Dividing this pressure drop by 12,155 feet, the pressure gradient required to overcome the effects of gravity is 0.012 psi/ft. In other words, taking into account the density difference between the water and gas, the injected water must overcome a gravity component of 149 psi in addition to the energy required for the water to displace the gas. Another example is illustrated in FIG. 15, where an injector and producer are horizontally separated by a distance of 2 miles (10,560 feet) and vertically separated by 370 feet. In this case, the injected water must overcome a gravity component of 130 psi in addition to the displacement energy required for the water to displace the gas.

Model Description

The concept of simultaneously producing the gascap and oil column was tested using a three-phase, black-oil, finite-difference simulator. A uniform aereal grid of 40 by 40 was superimposed on the reservoir structure. The reservoir has a uniform thickness of 60 feet and was divided into four, 115 feet layers. The simulation model contains 6400 cells (40 by 40 by 4). The cell size is 1100 ft. by 1400 ft. by 15 ft. Using a large, coarse cell size provided the option of making a large number of simulation runs.

Figure 2:
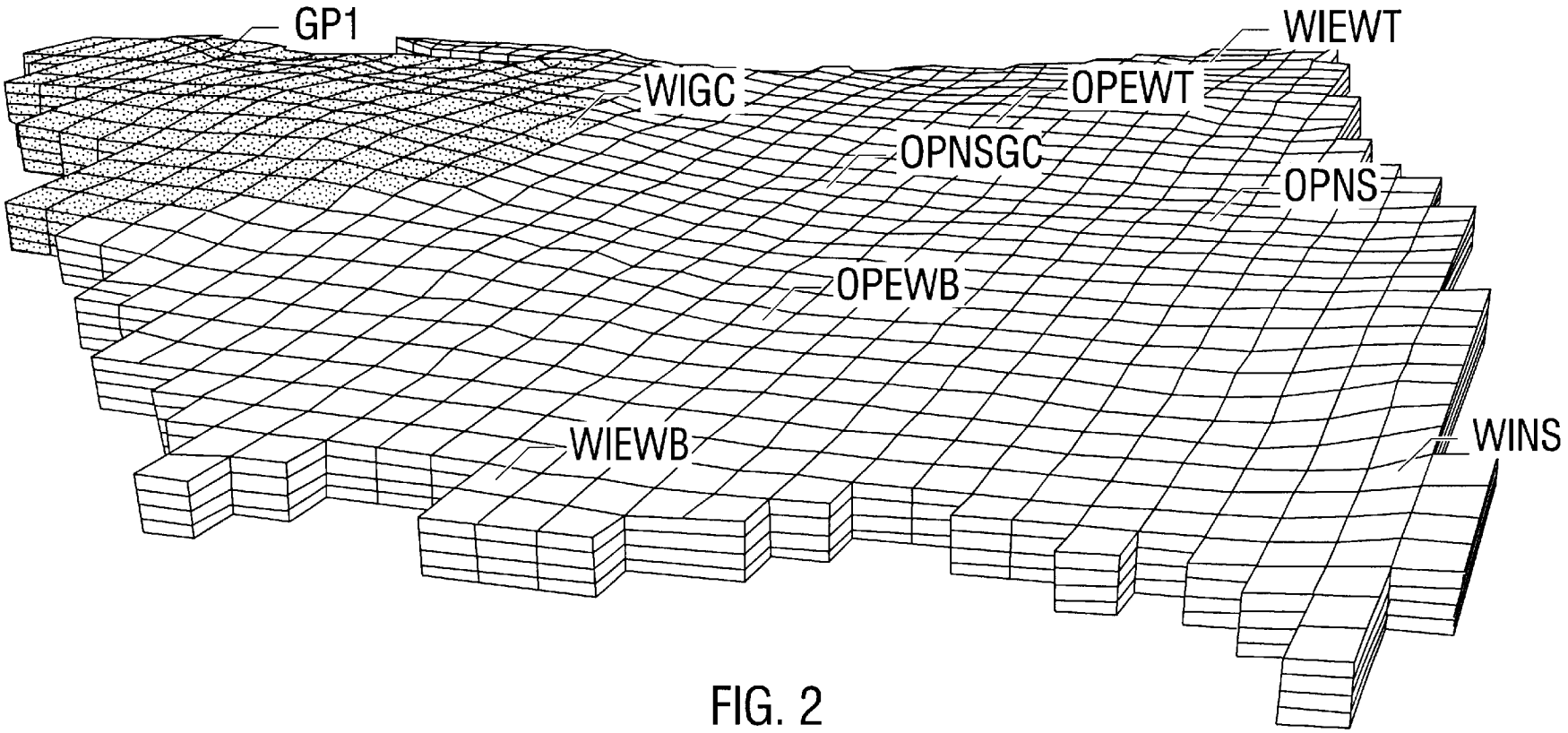
FIG. 2 shows a simulation reservoir grid/structure used for the reservoir model of the examples, with gas saturation shown at time equal to zero.

The grid imposed on the structure map is shown in FIG. 2. In this figure, the gascap is represented by the black region; the oil column is represented by the light gray region. In this case the reservoir was modeled with no aquifer support or oil-water contact. The formation dip in the gascap was approximately 2°. The horizontal distance between the injector at the gas oil contact and the gascap producer is approximately 12,155 feet. The length and width of the oil column are approximately 4 miles and 6 miles, respectively. The pore volumes and volumes of fluid in place are reported in Table 1. The gascap pore volume to oil pore volume ratio is 0.20. This reservoir contains 1,487 MMSTB of oil and 519 Bscf of gascap gas.

TABLE 1

| Pore Volumes and Fluids in Place | |
|---|---|
| Oil Pore Volume | 1,709,030 M res bbl |
| Gas Pore Volume | 346,933 M res bbl |
| Total Pore Volume | 2,055,963 M res bbl |
| Oil in Place | 1,487,107 MSTB |
| Volume of Gascap (Free Gas in Place) | 519,022 Mmscf |

TABLE 1-continued

| Pore Volumes and Fluids in Place | |
|---|---|
| Solution Gas in Place | 654,310 Mmscf |
| Total Gas in Place | 1,173,332 MMscf |

FIG. 2 shows the simulation grid of the model at time =0. The distance between the gascap producer and water injector at the gas-oil contact is approximately 12,155 feet. The oil column is approximately four miles long and six miles wide. The formation is 60 feet thick and in the simulation model four layers were used in the vertical direction.

Pertinent reservoir properties are listed in Table 2. The reservoir has an average permeability of 2500 md. A $k_V/k_H$ ratio of 0.1 was used in the simulation model to account for stratification in the reservoir. At the bubblepoint pressure of 3605 psia, the solution gas-oil ratio is 440 scf/STB, the formation volume factor is 1.15 RB/STB, and the oil viscosity is 8 cp. The gas viscosity is 0.02 cp and the water viscosity is 0.70 cp. Porosity is 20% and irreducible water saturation 30%. The residual oil saturation to water is 24% and the residual gas saturation to water is also 24%. Oil gravity was 18°. API. Corey-type correlations were utilized to generate the relative permeability curves.

TABLE 2

| Input Data for Base Case, Homogeneous Finite-Difference Simulation | |
|---|---|
| Horizontal Reservoir Permeability, md | 2500 |
| Ratio of Vertical to Horizontal Permeability | 0.1 |
| Porosity, % | 20 |
| Irreducible Water Saturation, % | 30 |
| Residual Oil Saturation to Water, % | 24 |
| Residual (or Trapped) Gas Saturation to Water, % | 24 |
| Oil Viscosity at the Bubblepoint Pressure, cp | 8 |
| Initial Reservoir Pressure at the Gas-Oil Contact, psia | 3605 |
| Bubblepoint Pressure, psia | 3605 |
| Reservoir Temperature, ° F. | 110 |
| Water Viscosity, cp | 0.70 |
| Gas Viscosity at the Bubblepoint Pressure, cp | 0.02 |
| Gas Specific Gravity | 0.65 |
| Solution Gas-Oil Ratio at the Bubblepoint Pressure, scf/STB | 440 |
| Formation Volume Factor at the Bubblepoint Pressure, RB/STB | 1.15 |

When the concept of simultaneously producing the gascap and oil column was utilized, the reservoir was produced using four oil producers located in the central region of the oil column (OPNSGC, OPEWT, OPNS, OPEWB), three water injectors located at the boundary or edge of the oil column (WIEWB, WIEWT, WINS), one water injector at the gas-oil contact (WIGC), and one gas producer located in the gascap (GPI), as illustrated in FIG. 2. All of these wells were modeled as horizontal wells, with laterals between 4400 to 6000 feet in length, and angles of deviation of about 90 degrees from the vertical. The oil producers are all completed in model layer 2 of 4, and the gas producer is completed in model layer 1 of 4. The water injectors are completed in model layer 2. The wellbore orientation is shown in FIG. 3.

Figure 3:
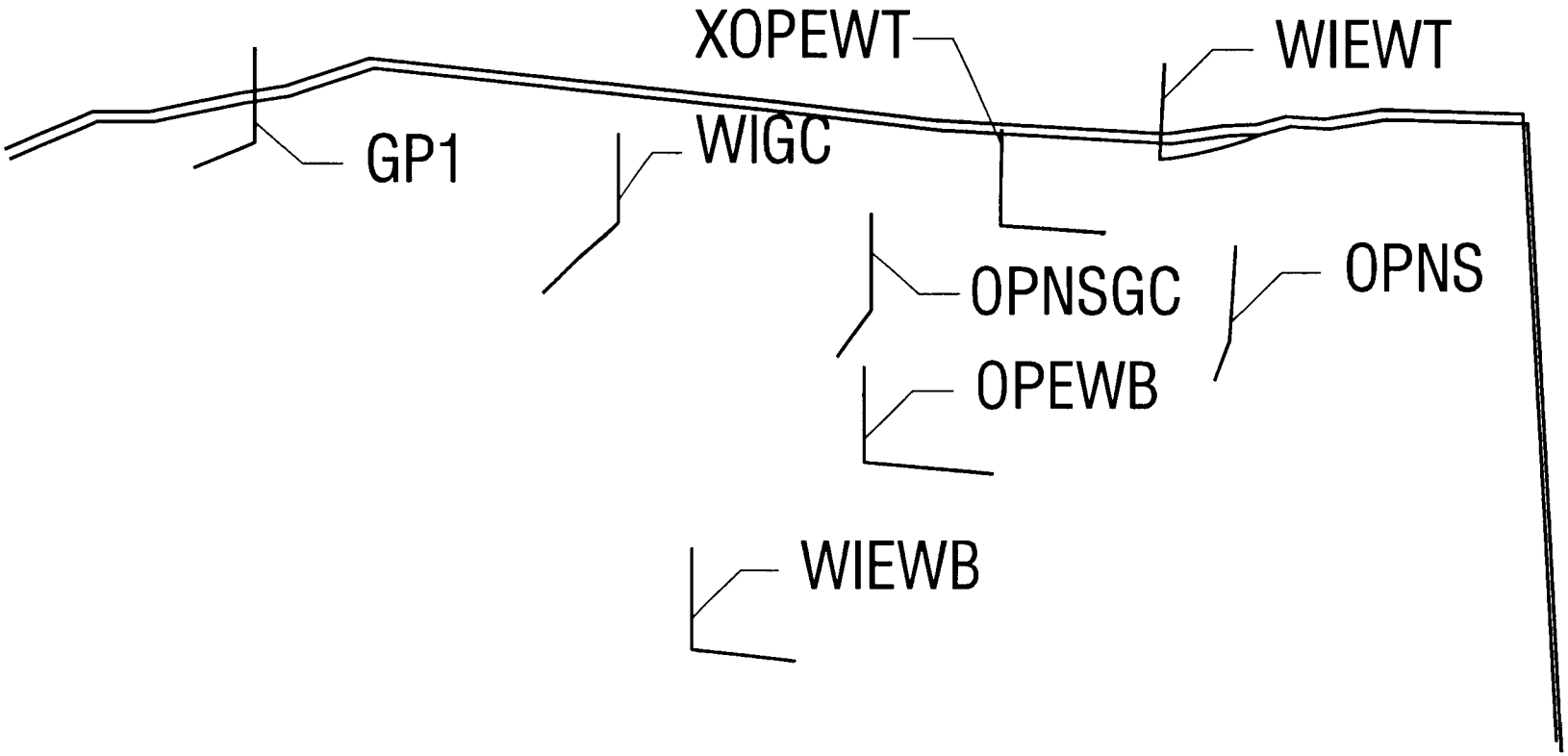
FIG. 3 shows a wellbore orientation in the simulated reservoir used for the reservoir model of the examples.

As illustrated in FIG. 3, the water injection wells (WIEWB, WIEWT, WINS) for this particular model are oriented in such a way as to create a water ring around the oil column. This may be done, for example, by distributing the location of water injection wells around or adjacent to the peripheral outer downdip boundary of an oil column. In this embodiment, the water injector at the gas-oil contact (WIGC) has a wellbore that essentially follows the profile of the gas-oil contact (for example, as dictated by the structural relief of the formation), and is long enough (in this case, 6,000 ft) to separate the gas and oil column with a "water fence" of desired length that exists between, and is drawn by, the pressure sinks created by producing both the gas cap producer and the oil production wells. With the illustrated well orientation, pressure sinks created by producing the gascap well (GP1) and the oil well that offsets the gas-oil contact (OPNSGC) will assist in creating a water wall or barrier between the gas cap and oil column by drawing the water both ways.

In the examples, one reservoir barrel of water was injected for each reservoir barrel of fluid produced in order to maintain full reservoir pressure. The injector to producer ratio is set at one to one everywhere except at the gas-oil contact. At the gas-oil contact, there is one water injector to the gascap producer and the OPNSGC oil column producer. The total withdrawal rate of these two wells is equal to the injection rate of the water injector at the gas-oil contact.

The maximum withdrawal rate for three of the oil producers (OPEWB, OPEWT, OPNS) was set to be 80,000 reservoir barrels per day per well ("RB/D/well")1. The maximum injection rate for three of the water injectors (WTEWB, WIEWT, WINS) offsetting these oil producers was also set at 80,000 RB/D/well. The maximum injection rate for the water injector (WIGC) at the gas-oil contact was also set at 80,000 RB/D. It is noted that in this reservoir configuration it was desired that this well inject enough water to support both the gascap producer (GP1) and the oil producer nearest the gas-oil contact (OPNSGC). Thus, these two wells were produced at a lower rate of 40,000 RB/D/well. For the gascap producer, the 40,000 RB/D equates to approximately 60 MMscf/D. The watercut limit for the gascap producer was set at 20% and the watercut limit for the oil producers was set at 95%. These limits were set to simulate abandonment production rates due to high levels of water production, and are merely assumptions. Actual abandonment conditions will vary depending on the production characteristics and economics of each individual case.

The above-mentioned rates are feasible based on the experience of the assignee of this patent application in developing the Captain Field in the North Sea. The Captain Field and the reservoir modeled in this Example have similar productivity indices.

Example 1

Simultaneous Production Results Using Homogenous Model

For Example 1, the following production scenario was simulated for a period of 25 years using the homogeneous simulation model.

The oil column is produced through the four oil producers while water is injected in all four water injectors, including at the gas-oil contact. In accordance with the disclosed method, the gascap is produced through the gascap producer (GP1) simultaneously as the oil column is depleted. The water injector at the gas-oil contact (WIGC) provides pressure support for both the gascap and oil column.

For the simultaneous production scenario, the water injected at the gas-oil contact isolates the gascap from the oil column, and moves as a vertical wall updip providing a very efficient, piston-like displacement of the gas. This is believed to occur due to the favorable water to gas viscosity ratio of approximately 35. It is also believed that water moves updip in a relatively "sharp" front because the pressure drop between the gas producer and the water injector at the gas-oil contact is large enough to cause the viscous forces to be larger than the gravitational forces. As water is injected at the gas-oil contact the simulation run also indicates that water moves downdip, sweeping oil to the oil producers. The model indicates that the front of water displacing oil is not nearly as sharp as the front of water displacing gas. The difference in the sharpness of the fronts may be explained by the difference between the relatively favorable water viscosity to gas viscosity ratio of approximately 35 for the water displacing gas front, versus the relatively unfavorable water viscosity to oil viscosity ratio of approximately 0.08 for the water displacing oil front.

FIGS. 5*a*, 5*b*, 5*c*, and 5*d* show the vertical cross-section of the area between the gascap producer and the water injector at the gas-oil contact. The spectrum scale is linear, with white representing the highest possible water saturation and black representing the initial gas saturation. FIGS. 5*a*, 5*b*, 5*c*, and 5*d* show the progression of the gas-water interface at 1, 4, 9, and 12 years. Although a small tongue of water in the lower layers precedes the front, the front for the most part is vertical. The residual gas saturation to water was assumed to be 24% in this simulation run. This trapped gas saturation is represented in FIGS. 5*a*, 5*b*, 5*c*, and 5*d* by the gray blocks behind the gas-water interface.

For optimal separation of the gascap and oil column water should be injected into a gas-oil contact injection well at a volumetric flow rate high enough to overcome the combination of the hydrostatic head gradient imposed by gravity and the displacement gradient. As used herein "displacement gradient" means the flow resistance gradient that must be overcome in order to displace fluid through a permeable matrix of the formation. The average pressure gradient is a summation of the displacement pressure gradient and the hydrostatic head gradient. This gradient will change during the life of the waterflood because the moving water front will cause the hydrostatic head gradient to increase. A simple mathematical explanation follows.

FIG. 1 is a simplistic representation of the simulated reservoir. The horizontal distance between the gascap producer and water injector at the gas-oil contact is 12,155 feet. The reservoir dip in the gascap region is 2°. The structural elevation distance between these two wells is 425 ft. At the start of water injection, the water will have to overcome both a pressure gradient due to the hydrostatic head of the gas and a pressure gradient due to the water having to displace the gas. The hydrostatic head gradient imposed by the gas gradient is equal to 0.003 psi/ft (equivalent to 425 ft*0.08 psi/ft)/12,155 ft). The pressure gradient due to the hydrostatic head will change as the waterflood advances up dip. When the water front reaches the gascap producer, the water will have to overcome a hydrostatic pressure gradient of 0.015 psi/ft (equivalent to 425 ft*0.43 psi/ft)/12,155 ft) in addition to the pressure gradient required for the water to displace the gas. The pressure gradient required for the water to displace the gas is expected to remain constant throughout the advancement of the front.

The pressure gradients for the simultaneous production scenario run were analyzed. The average pressure gradient between the gascap producer (GP1) and water injector at the gas-oil contact (WIGC) is 0.021 psi/ft. This gradient is more than adequate for the water to both overcome the effect of gravity and to displace the gas. For comparison, the average pressure gradient between one of the peripheral water injectors (WIEWB) and one of the central oil producers (OPEWB) is 0.142 psi/ft. The gradient required for water displacing oil is much higher than the gradient for water displacing gas.

On the oil side of the gas-oil contact, the average pressure gradient between the water injector at the gas-oil contact (WIGC) and the offsetting oil producer (OPNSGC) is 0.079 psi/ft. For the gascap containment case, the average pressure gradient between the water injector at the gas-oil contact and the offsetting oil producer is 0.086 psi/ft. The minimal difference in this gradient between these two production scenarios indicates that the production of the gascap does not significantly disrupt the displacement of oil by water on the oil side of the gas-oil contact.

Figure 6:
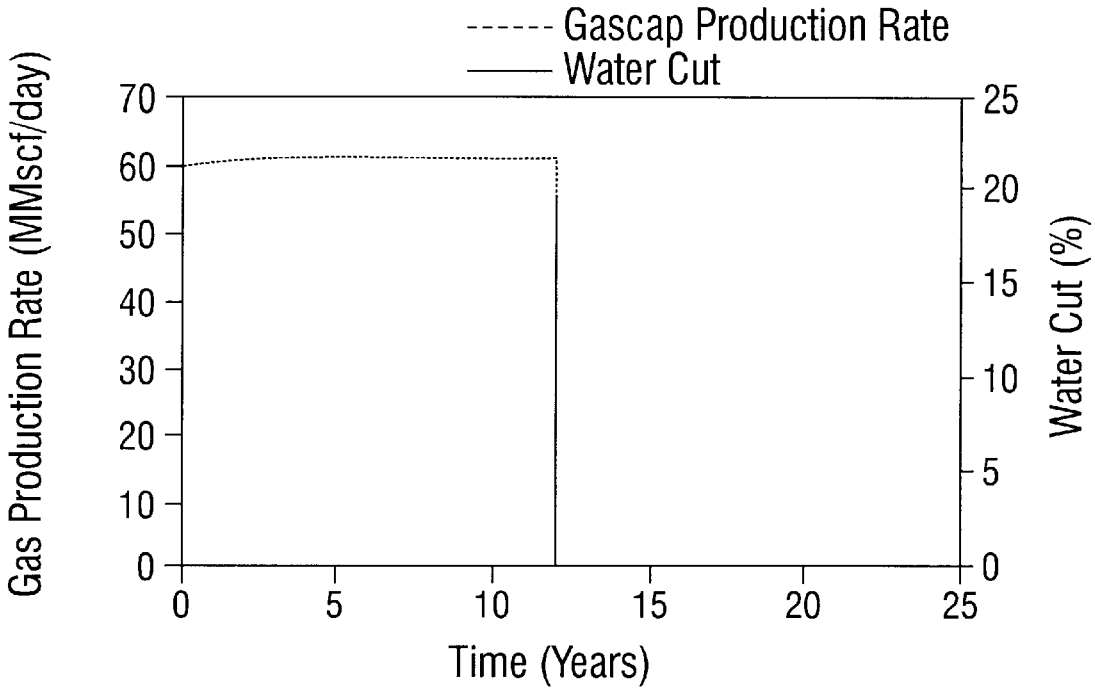
FIG. 6 shows modeled gas production rate and water cut of a gascap producer versus time for a reservoir produced according to one embodiment of the disclosed simultaneous production method.

In the simultaneous production scenario, the production from the gascap producer is approximately 60 MMSCF/D for the first 12 years of the project (FIG. 6). The gas production is water free up until the time the waterfront reaches the well. In the simulation model, the gascap producer is set to shut-in when the water cut exceeds 20%. For the homogeneous model, the watercut exceeds 20% in year 12. Because of a sharp, piston-like displacement by water, the after breakthrough gas production is negligible. Significantly, the gascap gas is produced during the first 12 years of the project, enhancing the present value of these reserves. Once the gascap production well is shut-in, water moves back down dip under the influence of gravitational forces and helps sweep the oil to the oil producers.

Comparative Example A

Depletion Scenario Using Homogenous Model

The following production scenario was simulated for a period of 25 years using the homogeneous simulation model.

In this comparative example, the oil column is produced through the four oil producers and no water is injected. The gascap is not produced, but expands to provide pressure support for the oil column. As may be seen in FIG. 4, this production methodology is not very efficient with oil recovery after 25 years being only 11.2% of original oil in place, with most of the oil being produced in the first ten years.

In this comparative example, the oil column is produced through the four oil producers while water is injected in all four water injectors, including at the, gas-oil contact. The gascap is not produced but is kept from expanding downward by a water wall created by injecting water at the gas-oil contact. As may be seen in FIG. 4, by injecting at all four water injectors, oil recovery after 25 years is increased to 30.6%.

Comparison of Results of Example 1 and Comparative Examples A–C

Figure 4:
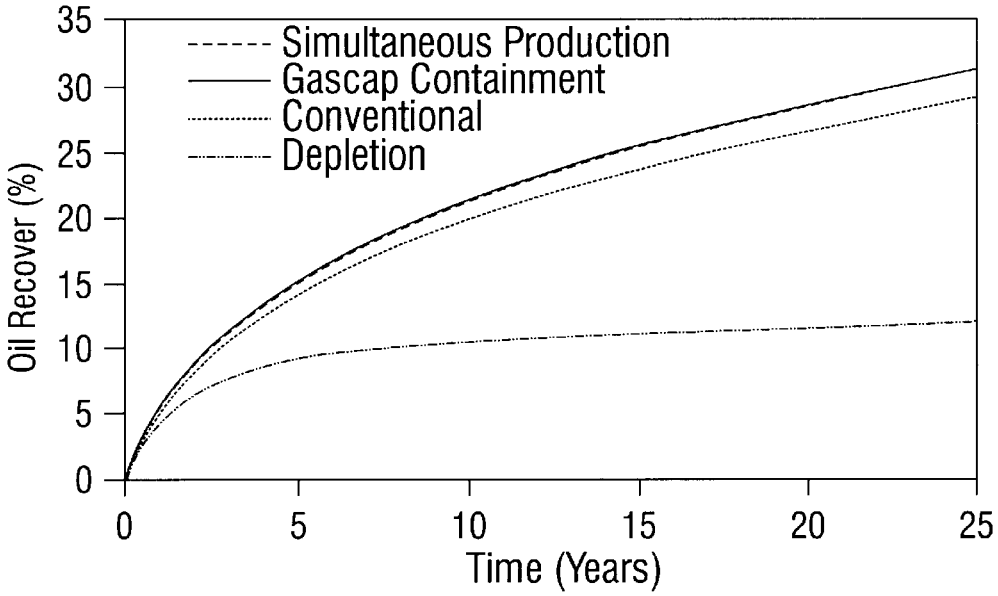
FIG. 4 shows oil recovery versus time for different modeled production scenarios, including a production scenario modeled according to one embodiment of the disclosed simultaneous production method.
Figure 5A:
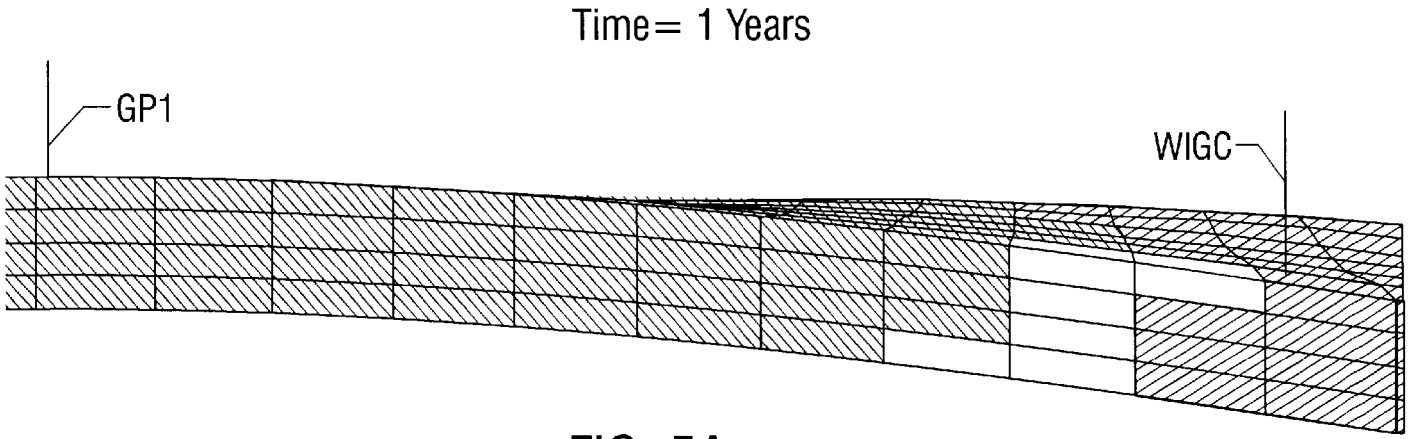
FIG. 5 a cross-sectional view of the gas cap of a simulated reservoir, showing water displacing gas for a reservoir model produced according to one embodiment of the disclosed simultaneous production method.
Figure 5B:
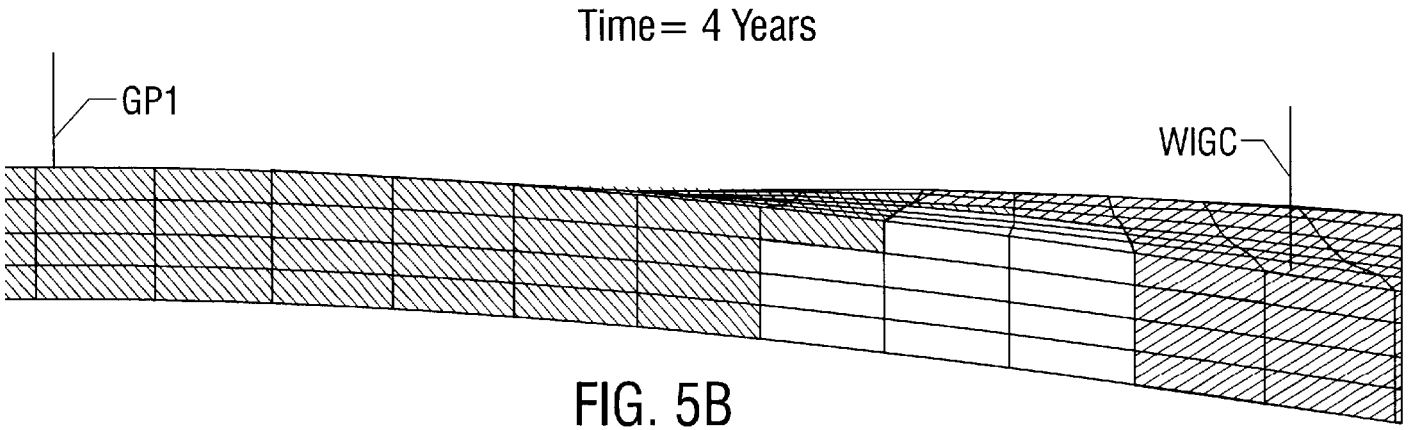
Figure 5C:
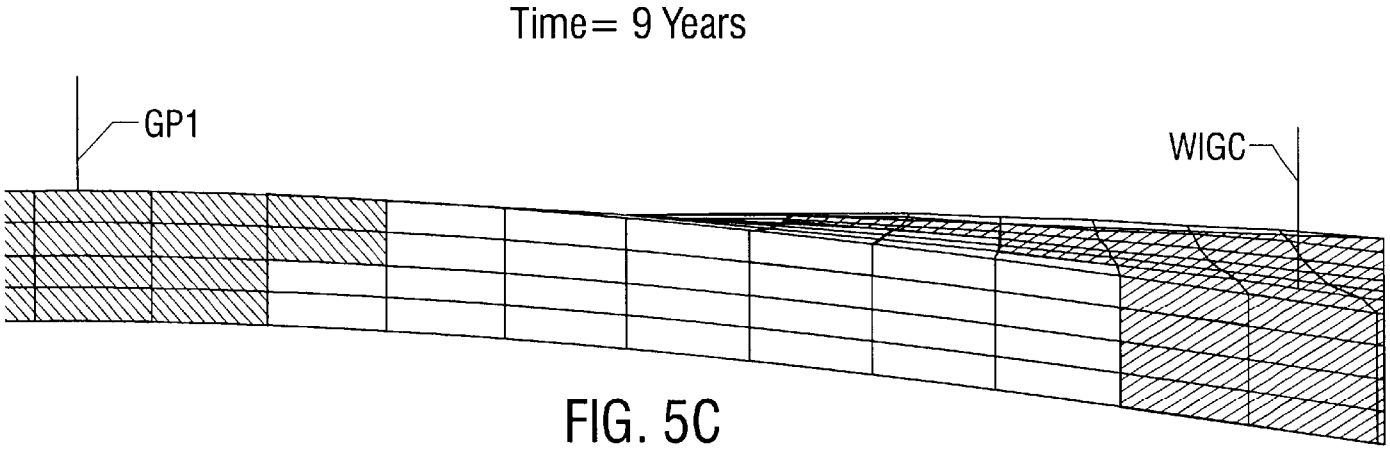
Figure 5D:
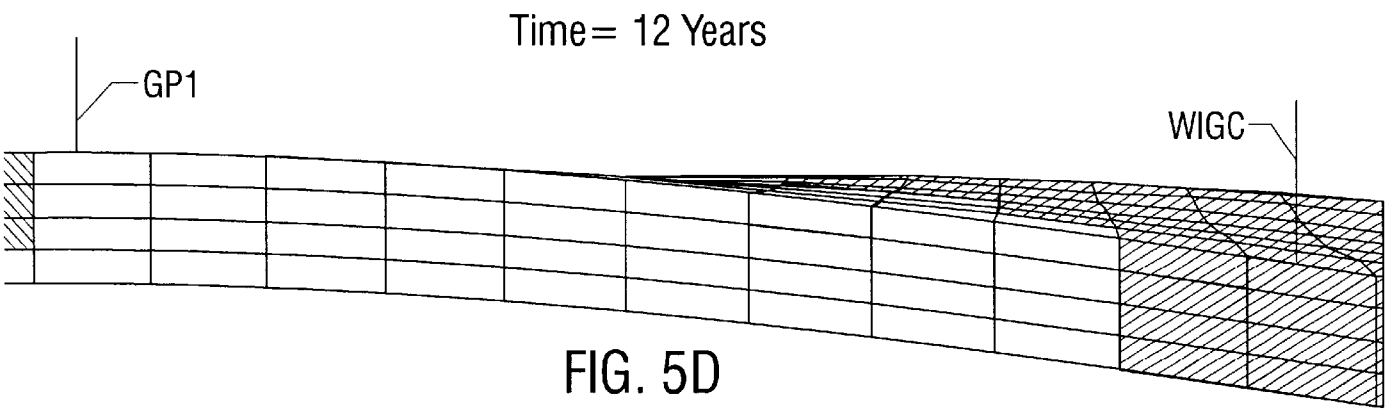

The performance summary after 25 years of production for each of the simulated scenarios is reported in Table 3. FIG. 4 shows the oil recovery versus time for each of the homogeneous production scenarios. The oil recovery for the depletion scenario after 25 years of production is 11.2% of original oil in place. This scenario was run to establish the base oil recovery for comparison purposes. The oil recovery for the conventional scenario is 28.3%. This scenario shows that injecting water increases the oil recovery factor by providing needed pressure support. The oil recovery for the gascap containment scenario is 30.6%. Comparing the oil recovery results for the conventional and gascap containment scenarios shows that containing the gascap through injecting water at the gas-oil contact increases oil recovery by 2.3% of original oil in place for the homogeneous system studied. For the reservoir of this Example, this increase is somewhat smaller than the oil recovery increase as a percent of original oil in place reported in the literature (4–10%). This is believed to be due to the lack of reservoir heterogeneity in the homogeneous model used for these examples.

TABLE 3

Performance Summary After 25 Years of Production

| Scenario | Oil Rec (%) | Gas Rec (% of Total Reservoir Gas) | Gascap Rec (%) | Cum Water Produced (MMSTB) | Cum Water Inj (MMSTB) | Water Inj/ HC Pore Volume | Water Inj/ Oil Pore Volume |
|---|---|---|---|---|---|---|---|
| Depletion | 11.2 | 66.6 | N/A | — | 0 | 0.00 | 0.00 |
| Conventional | 28.3 | 23.9 | N/A | 1,838 | 2,393 | — | 1.40 |
| Gascap Containment | 30.6 | 22.6 | 0.0 | 1,945 | 2,548 | — | 1.49 |
| Simultaneous Production | 30.4 | 40.3 | 54.7 | 1,989 | 2,717 | 1.32 | — |

Comparative Example B

Conventional Scenario Using Homogenous Model

The following production scenario was simulated for a period of 25 years using the homogeneous simulation model.

In this comparative example, the oil column is produced through the four oil producers while water is injected in the three peripheral water injectors (WIEWB, WIEWT, WINS), but not at the gas-oil contact. The gascap is not produced, but expands to provide pressure support to the oil column. As may be seen in FIG. 4, by injecting water at three of the four water injectors, oil recovery is increased over the depletion model to 28.3% of the original oil in place after 25 years.

Comparative Example C

Gascap Containment Scenario Using Homogenous Model

The following production scenario was simulated for a period of 25 years using the homogeneous simulation model.

The oil recovery for the simultaneous production scenario is 30.4%. This recovery is not significantly different than the 30.6% computed for the gascap containment scenario. Comparing the oil recovery results for the gascap containment and simultaneous production scenarios indicates that the simultaneous production of the gascap and oil column is not detrimental to the total field oil recovery. It should also be noted that (as shown in FIG. 4) the rate of oil recovery for these two scenarios is virtually identical as indicated by the curves overlying each other. However, in the simultaneous production scenario, production from the gas cap is significantly accelerated.

Also reported in Table 3 is the gas recovery for each of the simulated scenarios. The total reservoir gas recovery column includes both the recovered solution gas and gascap gas. The total reservoir gas recovery varies from 22.6% for the gascap containment scenario to 66.6% for the depletion scenario. For the depletion scenario the reservoir abandonment is assumed to be 1000 psia. For the simultaneous production case, the gascap recovery is 54.7% of the initial gascap gas in place. Gas from the gascap was produced in the depletion and conventional production scenarios; however, no attempt was made to compute the percentage of the total gas production attributable to the gascap gas.

The cumulative water produced results show that there is little variation between the amount of water produced among the cases in which water is injected. Also reported in Table 3 is the cumulative water injected. For the conventional and gascap containment scenarios, the gascap is not waterflooded and thus, the ratio of cumulative water injected to oil pore volume is tabulated. For the simultaneous production scenario, the gascap is waterflooded and thus, the ratio of cumulative water injected to hydrocarbon (HC) pore volume is reported. In all scenarios where water is injected, the amount of injected water exceeds one hydrocarbon pore volume.

A comparative analysis of these four scenarios indicates that the simultaneous production of oil and gas is the most viable production option because it enhances cashflow through early gas sales, assuming a ready gas market exists.

Since the oil-recovery versus time curve is basically the same for both the gascap containment and the simultaneous production scenarios (FIG. 4), comparative economics between a simultaneous production scenario and a gas containment scenario typically depends on the tradeoff between the accelerated cashflow from earlier gas sales in the simultaneous production scenario and any reduced overall cashflow which may result from lower gas recovery due to gas being trapped behind the advancing waterfront. This immediate sale of gas can improve the net present value of a project significantly. In one economic scenario for the reservoir studied, the difference in net present value between the simultaneous production scenario and the conventional scenario with the gascap blown down after 25 years of oil production is $100 million, a 25% increase.

Example 2

Simultaneous Production Scenario at Various Residual Gas Saturations

Residual or trapped gas saturation to water is one of variable which may be evaluated while studying the economical feasibility of simultaneously producing the gascap and oil column according to the disclosed method. This parameter may be measured in the laboratory on a fresh core sample from the reservoir in question. However, for this example a range of values for residual gas saturation to water, Sgrw, was obtained from the literature. In this regard, Chierici et al. measured Sgrw to be 18% to 26% for unconsolidated sands. For consolidated sands, Fishlock et al. measured Sgrw to be 35% on a high permeability sample. In Example 1 and Comparative Examples A–C, an Sgrw value of 24% was used.

Figure 7:
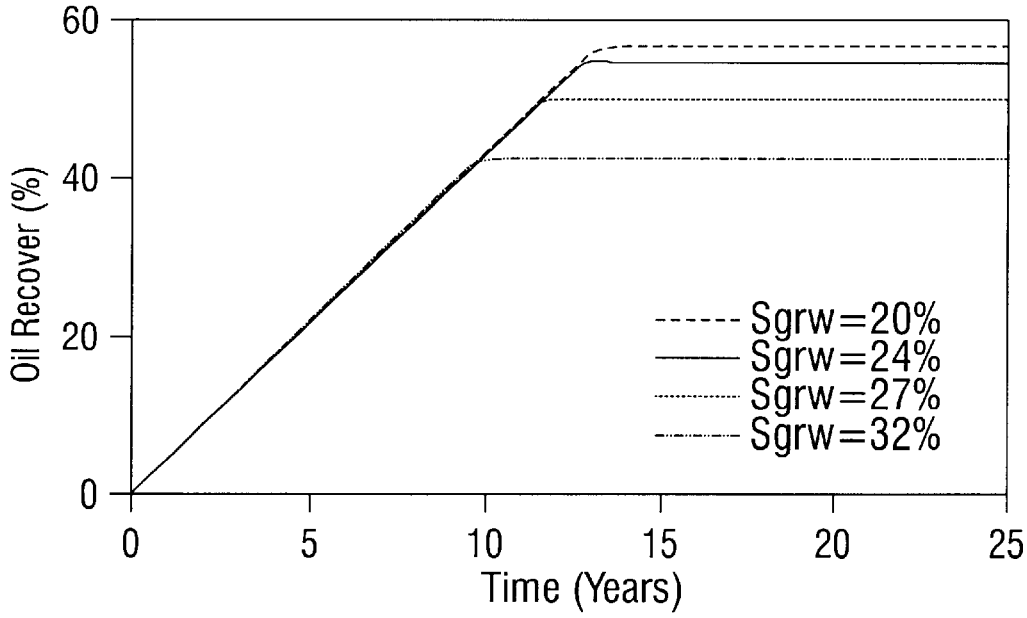
FIG. 7 shows modeled gascap recovery versus time for a reservoir produced according to one embodiment of the disclosed simultaneous production method, and for varying values of residual gas saturation to water.

For this example, an Sgrw range of 20% to 32% was investigated. To determine the sensitivity of the gascap recovery to the variable of trapped gas saturation in water, a series of additional simultaneous production scenario runs were made using Sgrw values of 20%, 27%, and 32%. The gascap recovery for each of these runs is shown in FIG. 7. As may be seen, the gascap recovery varies from a high of 57% when Sgrw equals 20%, to a low of 42% when Sgrw equals 32%. Intuitively this is what one would expect, since the more residual gas that is trapped in the reservoir, the less gas that may be expected to be recovered at the surface.

Example 3

Effect of Reservoir Heterogeneity on Simultaneous Production Scenario

In this example, the effect of permeability variation on the oil and gas recoveries obtained using the simultaneous production methodology was investigated. The homogeneous model simulation results demonstrated that gas from the gascap can be produced simultaneously without significantly affecting oil recovery. This example was performed to determine how permeability variation may be expected to affect the process of simultaneously producing the gascap and oil column.

Figure 8:
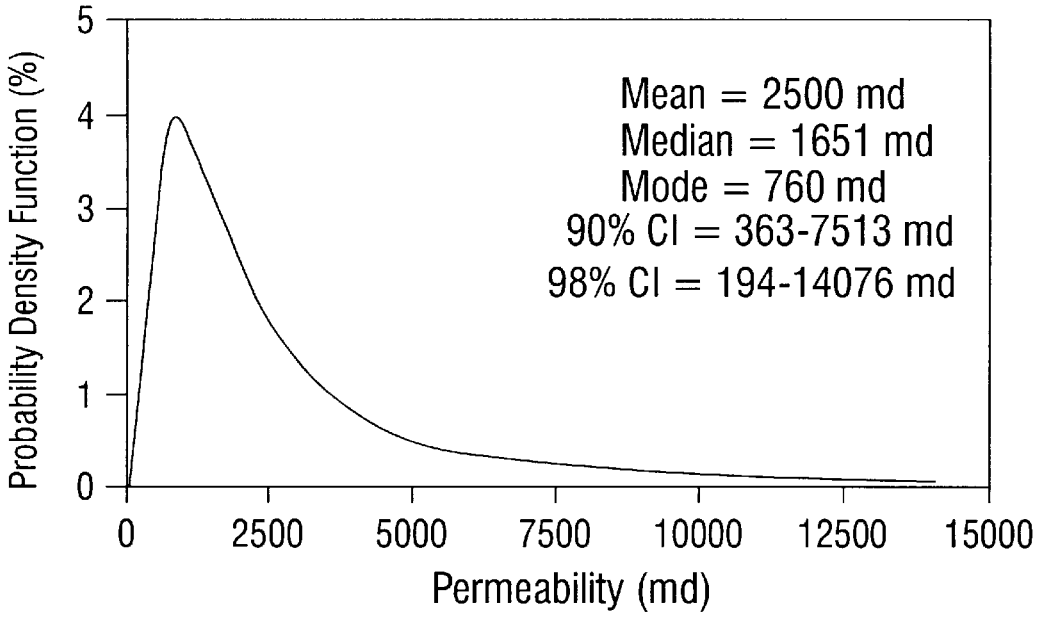
FIG. 8 shows probability density function of permeability utilized in a reservoir model presented in the examples discussed herein.

The probability density function of permeability used in this study is shown in FIG. 8. This distribution is lognormal and has a mean of 2500 md, the same mean as the homogeneous case. The median is 1651 md, the node is 760 md, 90% of the values lie between 363–7,513 md, and 98% of values lie between 194–14,076 md. Because the distribution is lognormal, a large percentage of the values are lower permeability values, with 49% of the values falling within the range of 194–1651 md. In the simulation runs, these lower-permeability cells will slow the flow of water and this will distort the waterflood front.

The effects of heterogeneity were studied using a reservoir description provided by two different geostatistical models: layered sand/shale and variable sand/shale. These models were constructed using the above-described probability density function of permeability. The pertinent variogram information for each model is given in Table 4. Unconditional simulation was used to generate five equally-likely realizations for each model. Each model realization was run to simulate the simultaneous production of the gascap and oil column. Identical input parameters and constraints were used in each model run, the only difference being in the permeability variation.

TABLE 4

| | Variogram Information | |
|---|---|---|
| | Layered Sand/Shale Model | Variable Sand/Shale Model |
| Major Correlation Length | 10,000 ft | 2,000 ft |
| Minor Correlation Length | 10,000 ft | 2,000 ft |
| Vertical Correlation Length | 13 ft | 50 ft |
| The Aereal Correlation Length Ratio | 1.0 | 1.0 |
| The Vertical Correlation Length Ratio | 800.0 | 40.0 |
| Azimuth Degree | 0.0 | 0.0 |
| Variogram Model | 0.2 Fractal | 0.2 Fractal |

Figure 9A:
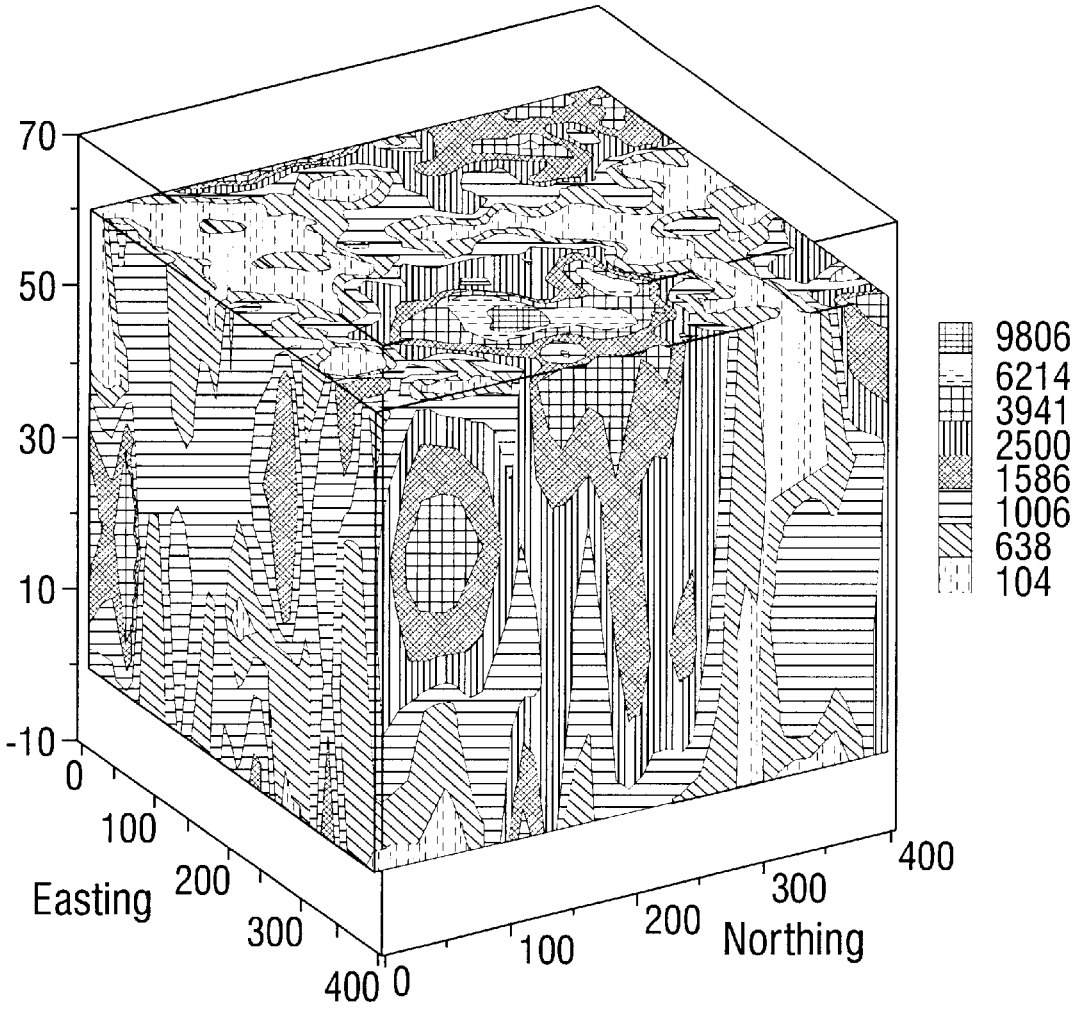
FIGS. 9*a* and 9*b* show spatial permeability distribution for a layered sand/shale model and a variable sand/shale model utilized in reservoir model runs presented in the examples discussed herein.
Figure 9B:
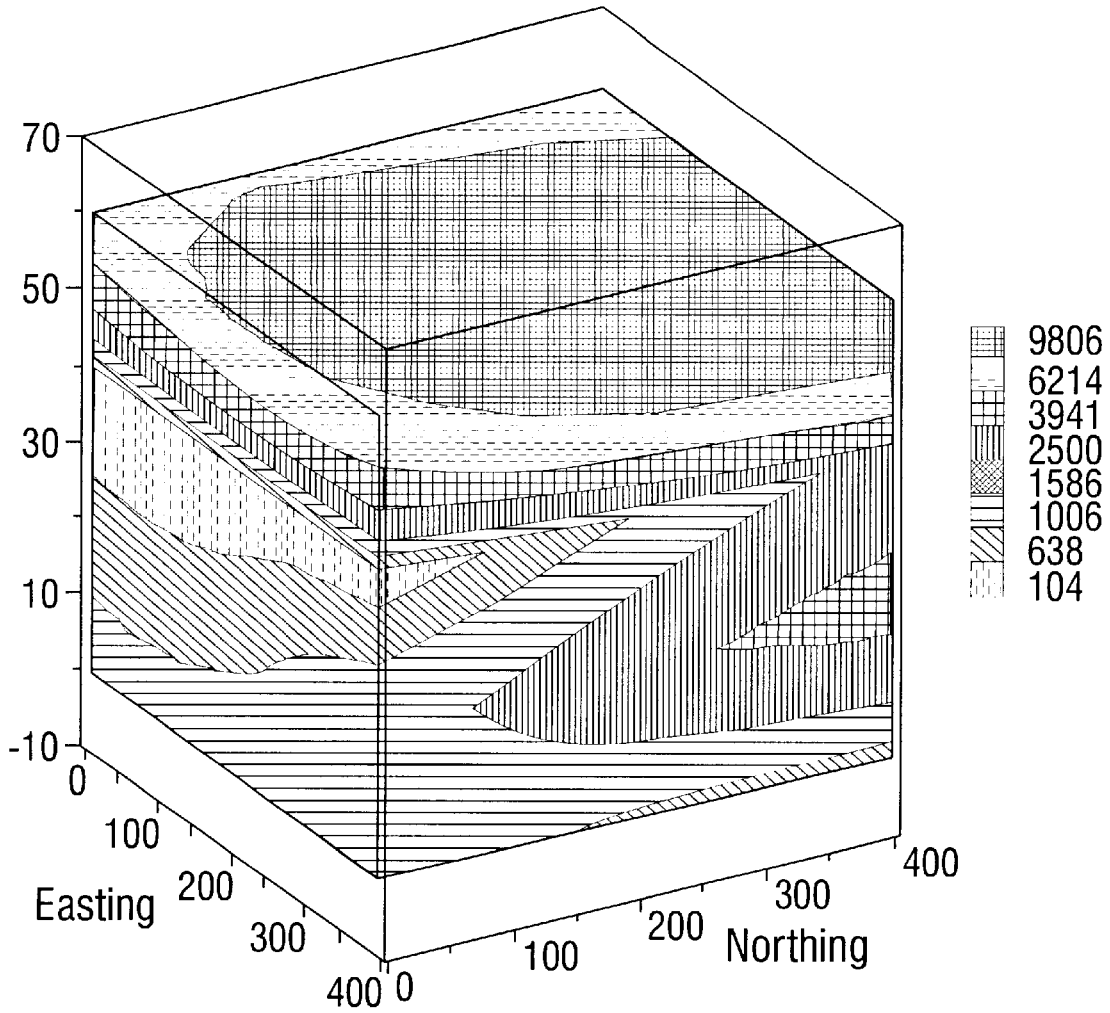

The permeability distribution for one of the equally-likely realizations for both the layered sand/shale model and variable sand/shale model is shown in FIGS. 9*a* and 9*b*. As indicated by the variogram information in Table 4 and in FIGS. 9*a* and 9*b*, these models are significantly different. The variogram of the layered sand/shale model forces its permeability to be somewhat continuous in the aereal plane and to vary significantly in the vertical plane. The variogram for the variable sand/shale model forces its permeability to vary significantly in both the aereal and vertical planes. Interestingly, the layered sand/shale model is much more continuous in the aereal plane than is the variable sand/shale, while the variable sand/shale model is more continuous in the vertical plane.

Layered Sand/Shale Model Results

Figure 10:
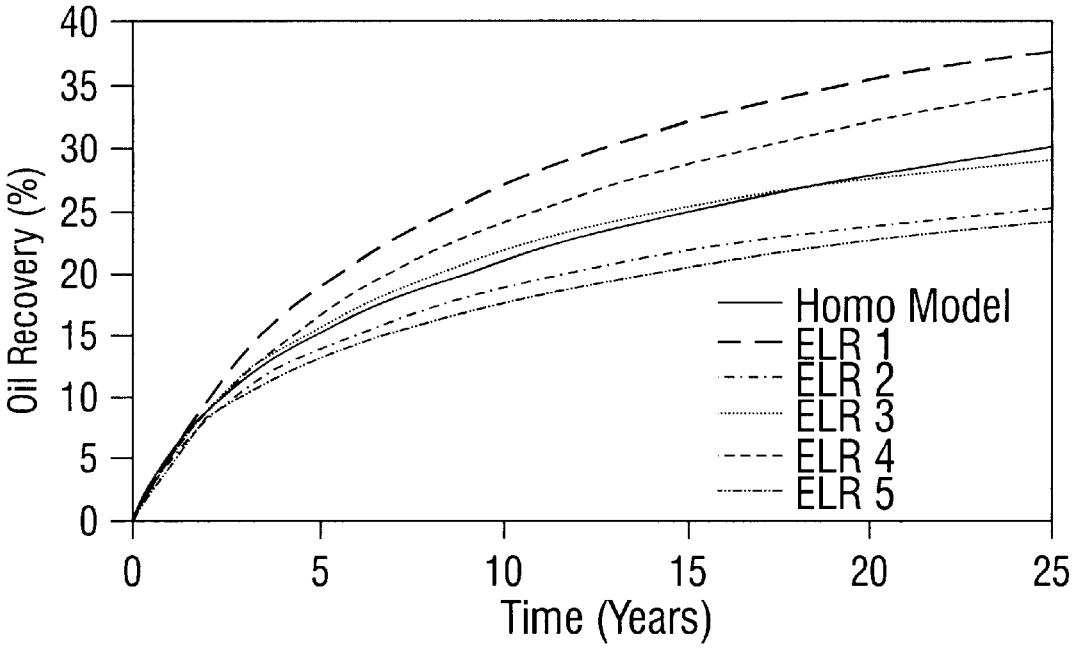
FIG. 10 shows modeled oil recovery versus time for the layered sand/shale equally likely realization runs of a reservoir produced according to one embodiment of the disclosed simultaneous production method.

The oil recoveries for the five equally-likely realizations (ELRs) of the layered sand/shale model vary from 24.4% to 38.0%, with the average of the five ELR runs being 30.4% (Table 5 and FIG. 10). The wide range in the oil recoveries for the five ELR models indicates that heterogeneity can lead to very different water-oil displacement efficiencies, both favorable and unfavorable as compared to displacement efficiencies under more homogeneous conditions. This results in varying oil recovery efficiency. The distribution of the ELR oil recoveries both above and below the oil recovery for the homogeneous case is believed to be due to a layering effect. A higher oil recovery was observed to be obtained when the ordering of the permeability is such that the high-permeability layers are at the top of the structure and the low-permeability layers are at the bottom of the structure. For such a system, the viscous forces are believed to counteract the gravitational forces to increase displacement efficiencies and to achieve a more piston-like displacement. A lower oil recovery was observed when the layering order is reversed and the low-permeability layers are at the top of the structure and the high-permeability layers are at the bottom of the structure. In this system, the viscous forces and gravitational forces are believed to work together to decrease displacement efficiencies.

TABLE 5

Cumulative Recoveries After 25 Years for Heterogeneous Model Runs

| | Layered Sand/Shale | | Variable Sand/Shale | |
|---|---|---|---|---|
| Model | Oil Recovery (%) | Gascap Recovery (%) | Oil Recovery (%) | Gascap Recovery (%) |
| Homogenous | 30.4 | 54.7 | 30.4 | 54.7 |
| ELR 1 | 38.0 | 51.6 | 28.2 | 55.7 |
| ELR 2 | 25.4 | 52.0 | 22.2 | 58.7 |
| ELR 3 | 29.3 | 53.2 | 24.3 | 54.2 |
| ELR 4 | 34.9 | 55.0 | 34.9 | 55.0 |
| ELR 5 | 24.4 | 53.6 | 24.4 | 53.5 |
| Average of 5 ELR Runs | 30.4 | 53.1 | 26.8 | 55.4 |

Figure 11:
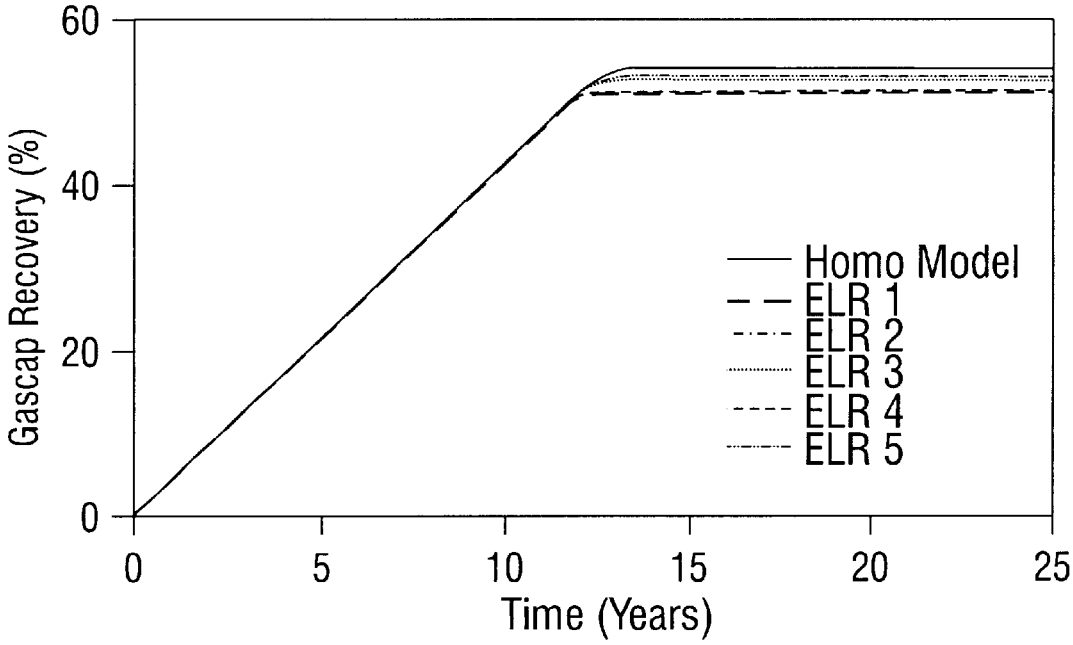
FIG. 11 shows modeled gascap recovery versus time for the layered sand/shale equally likely realization runs of a reservoir produced according to one embodiment of the disclosed simultaneous production method.

The gascap recoveries for the ELRs of the layered sand/shale model vary within the narrow range of 51.6% to 55.0%, with an average of 53.1% (Table 5 and FIG. 11). These values are very close to the gascap recovery value of 54.7% for the homogeneous case. These results indicate that heterogeneity does not significantly affect the gascap recovery when the production methodology of simultaneously producing the gascap and oil column is utilized. It is believed this is due, at least in part, to the very piston-like displacement in the gascap due to the favorable water to gas viscosity ratio (approximately 35). The displacement of gas by injecting water at the gas-oil contact is an efficient process. The favorable water/gas viscosity ratio causes the viscous forces to dominate the gravitational forces resulting in an efficient, piston-like displacement. The benefits of having a favorable viscosity ratio so influence recovery that even introducing large permeability variations into the reservoir model does not significantly affect the gascap recovery. In other words, the effects of heterogeneity on gas recovery are believed to be minimized because the gas can effectively "outrun" the advancing waterfront. Significantly, this means that the simultaneous production of the gas cap and oil column according to the disclosed method is even more advantageous when reservoir heterogenities adversely affect oil recovery. This is because under these conditions, gas production makes up an even larger percentage of the overall production (and thus cash flow) from the reservoir.

Variable Sand/Shale Model Results

Figure 12:
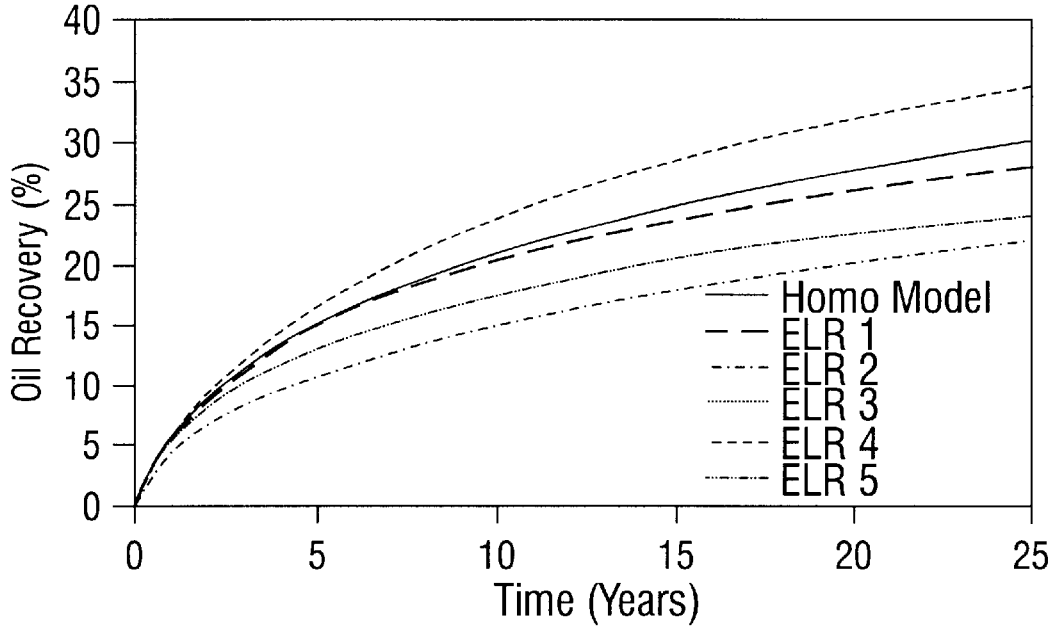
FIG. 12 shows oil recovery versus time for the variable sand/shale equally likely realization runs of a reservoir produced according to one embodiment of the disclosed simultaneous production method.

The oil recoveries for the five ELRs of the variable sand/shale model vary from 22.2% to 34.9%, with an average of 26.8% (Table 5 and FIG. 12). Once again, the wide range in oil recoveries for the five ELR models indicates that heterogeneity can lead to very different water-oil displacement efficiencies, and thus very different oil recovery efficiencies. The variable sand/shale model has more permeability variation in the aereal direction, which causes lower recoveries in general than the layered sand/shale model.

Figure 13:
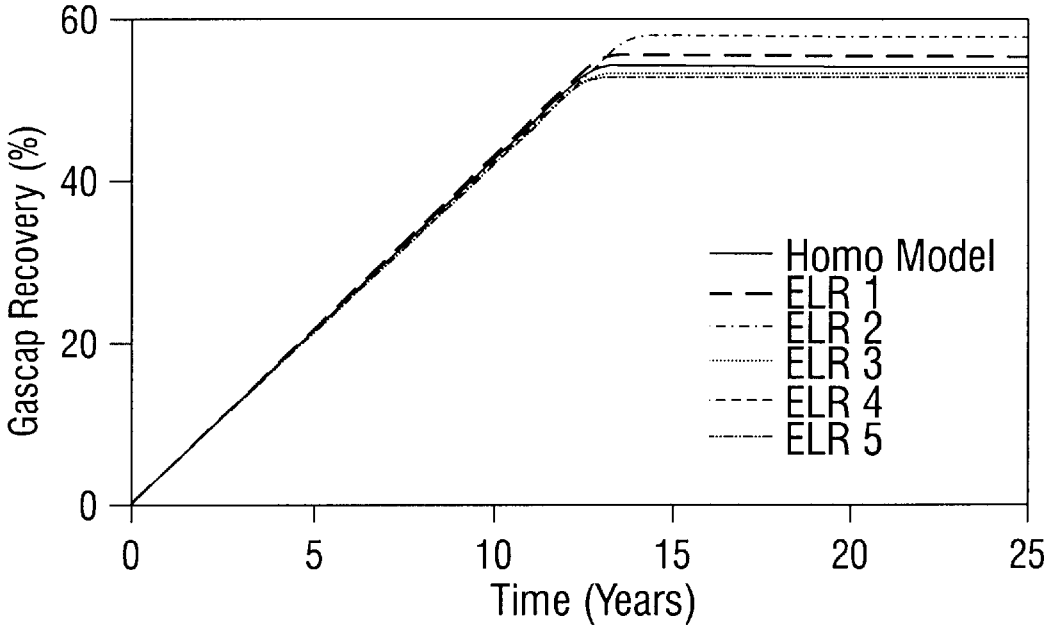
FIG. 13 shows modeled gascap recovery versus time for the variable sand/shale equally likely realization runs of a reservoir produced according to one embodiment of the disclosed simultaneous production method.

The gascap recoveries for the ELRs of the variable sand/shale model vary within the narrow range of 53.5% to 58.7%, with an average of 55.4% (Table 5 and FIG. 13). Once again, these values are very close to gascap recovery value of 54.7% for the homogeneous case. Thus, the same observations made for the layered sand/shale model are applicable to the variable sand/shale model. Once again, the effects of heterogeneity on gas recovery are believed to be minimized because the gas can effectively "outrun" the advancing waterfront.

Conclusions on Effects of Reservoir Heterogeneity

Since the gascap recovery is relatively constant for both the layered sand/shale model and variable sand/shale model, the revenue from the gascap will constitute a higher percentage of the project net present value if reservoir heterogeneity is such that the oil recovery from a given reservoir is low. For such reservoirs, simultaneously producing the gascap and oil column is very attractive. On the other hand, when reservoir heterogeneity is such that oil recovery from a given reservoir is high, this production methodology will still be attractive, because early gas production will also increase net present value.

Example 4

Figure 16:
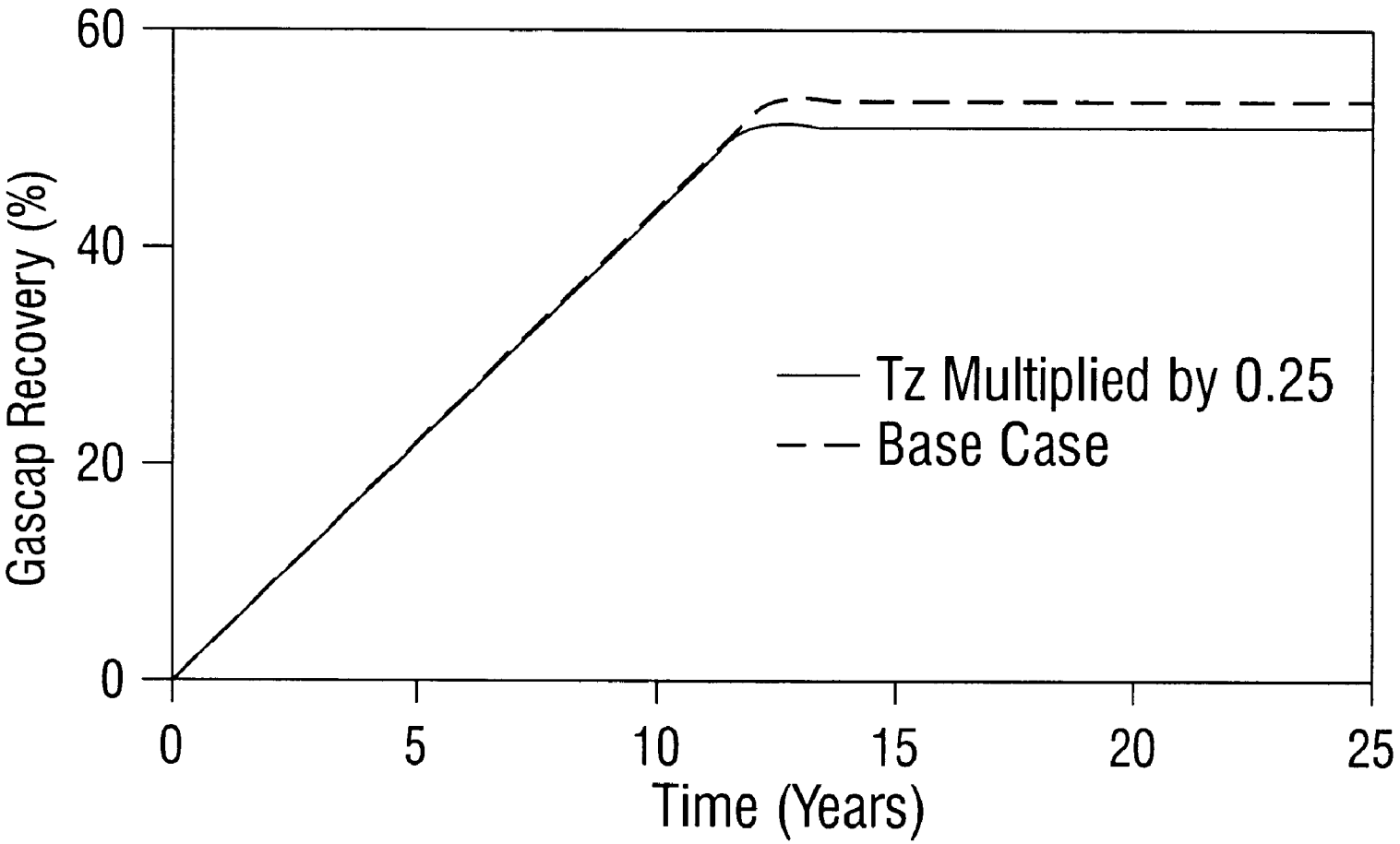
FIG. 16 shows modeled gascap recovery versus time for two values of reservoir vertical transmissibility ($T_Z$).

FIG. 16 shows modeled gascap recovery versus time for two values of reservoir vertical transmissibility ($T_Z$).

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods may be utilized in various combinations and/or independently. Thus the invention is not limited to only those combinations shown herein, but rather may include other combinations.

What is claimed is:

1. A method of producing fluids from a subterranean formation having a gas cap, an oil column, and a gas-oil contact therebetween, comprising:

introducing a first injection fluid into said formation at a first location adjacent said gas-oil contact; and producing gas and oil from said subterranean formation by simultaneously producing gas from a second location in said gas cap and producing oil from a third location in said oil column.

2. The method of claim 1, wherein said first injection fluid is introduced at said first location through a wellbore penetrating said subterranean formation, said wellbore having an angle of deviation at said subterranean formation of greater than about 75 degrees with respect to the vertical.

3. The method of claim 1, wherein said gas is produced from said second location and said oil is produced from said third location through wellbores penetrating said subterranean formation at each location with an angle of deviation at said subterranean formation of greater than about 75 degrees with respect to the vertical.

4. The method of claim 1, wherein said first injection fluid is water and is introduced at a flow rate sufficient so that said water moves upward into said gas cap.

5. The method of claim 4, wherein said first injection fluid is introduced at a flow rate effective to overcome the combination of hydrostatic and displacement pressure gradients so that said water moves upward into said gas cap.

6. The method of claim 1, wherein said first injection fluid is introduced into said formation at a flow rate effective to substantially separate said gas in said gas cap from said oil in said oil column in an area of said formation adjacent said first location where said first injection fluid is introduced.

7. The method of claim 1, wherein said subterranean formation has an average angle of formation dip less than or equal to about 45 degrees from the horizontal at the location of said gas-oil contact.

8. The method of claim 1, wherein said first injection fluid is introduced at a flow rate effective to maintain said reservoir pressure at a substantially constant value in at least a drainage area defined between said first location and said second and third locations during production of gas and oil from said subterranean formation from said respective second and third locations.

9. The method of claim 1, wherein said first injection fluid is at least one of an aqueous-based liquid, a gas that is liquid under conditions of reservoir temperature and pressure, or a mixture thereof.

10. The method of claim 1, wherein said first injection fluid is introduced at a flow rate effective to prevent or substantially reduce migration of said gas in said gas cap downdip in said subterranean formation in an area adjacent said first location in said subterranean formation.

11. The method of claim 1, further comprising introducing a second injection fluid into said subterranean formation at a fourth location in said oil column, said fourth location being positioned within said oil column.

12. The method of claim 11, wherein said second injection fluid is an aqueous based fluid, a gas, a gas that is liquid under conditions of reservoir pressure and temperature, or a mixture thereof.

13. The method of claim 1, wherein a gas-oil ratio of said oil produced at said third location is maintained at a value about equivalent to the solution gas-oil ratio of the oil in said oil column.

14. The method of claim 11, wherein reservoir voidage rate from a production of reservoir fluids from said subterranean formation is substantially balanced by the introduction rate of said first and second injection fluids into said subterranean formation.

15. The method of claim 1, wherein said subterranean formation has an average angle of formation dip of less than or equal to about 10 degrees from the horizontal.

16. The method of claim 1, wherein said subterranean formation has an average angle of formation dip of from about 10 degrees to about 1 degree from the horizontal.

17. The method of claim 1, wherein said first injection fluid introduced into said subterranean formation at said first location forms a fluid barrier at said gas-oil contact, said fluid barrier separating said oil from said gas over at least a portion of the area of said gas-oil contact.

18. The method of claim 17, wherein a gas-fluid barrier contact and a oil-fluid barrier contact are defined at the respective interfaces between said fluid barrier and said gas cap and said fluid barrier and said oil column; and wherein said gas-fluid barrier contact moves in a direction updip in said subterranean formation, and wherein said oil-fluid barrier contact moves in a direction downdip in said subterranean formation.

19. A method of producing an oil reservoir having a gas cap, an oil column, and a gas-oil contact therebetween, comprising:

introducing a first injection fluid into said reservoir at or adjacent to said gas-oil contact of said reservoir; and producing gas and oil from said reservoir by simultaneously producing gas from said gas cap and producing oil from said oil column.

20. The method of claim 19, wherein said first injection fluid is introduced through at least one deviated wellbore penetrating said reservoir at a location of said gas-oil contact; wherein said gas is produced from said gas cap through at least one second deviated well bore penetrating said reservoir at a location of said gas cap; and wherein said oil is produced from said oil column through at least one third deviated wellbore penetrating said reservoir at a location of said oil column; each of said respective deviated wellbores having an angle of deviation from about 30 degrees to about 90 degrees at the reservoir formation depth.

21. The method of claim 19, wherein a volumetric withdrawal rate of fluid from said reservoir measured at reservoir conditions is substantially equal to a volumetric introduction rate of fluid into said reservoir measured at reservoir conditions.

22. The method of claim 19, further comprising introducing a second injection fluid at a reservoir subsea depth that is substantially equal to or downdip of the depth at which said oil is produced from said reservoir.

23. The method of claim 22, said second injection fluid is introduced into or beneath said oil column.

24. The method of claim 22, wherein said oil column underlies said gas cap, and wherein said second injection fluid is introduced into said reservoir in a peripherally spaced manner.

25. The method of claim 22, wherein said first injection fluid is at least one of an aqueous-based liquid, a gas that is liquid under conditions of reservoir temperature and pressure, or a mixture thereof.

26. The method of claim 25, wherein said second injection fluid is an aqueous based fluid, a gas, a gas that is liquid under conditions of reservoir pressure and temperature, or a mixture thereof.

27. The method of claim 22, wherein said reservoir comprises a subterranean formation having an average angle of formation dip from about 10 degrees to about 1 degree from the horizontal at the location of said gas-oil contact in said reservoir.

28. The method of claim 19, wherein said reservoir comprises a subterranean formation having an angle of dip at said gas-oil contact; wherein said first injection fluid forms a barrier in contact with at least a portion of said gas-oil contact, said fluid barrier separating said oil column from said gas cap over at least a portion of the area of said gas-oil contact and wherein a gas-fluid barrier contact and a oil-fluid barrier contact are defined at the respective interfaces between said gas cap and said fluid barrier and between said oil column and said fluid barrier; and wherein introduction of said first injection fluid is effective to cause said gas-fluid barrier contact to move updip in said subterranean formation, and to cause said oil-fluid barrier contact to move downdip in said subterranean formation.

29. The method of claim 19, wherein said reservoir is substantially isolated from water influx, and further comprising maintaining the average reservoir pressure of said formation at a pressure above the bubble point of said oil column in said reservoir.

30. The method of claim 19, further comprising ceasing production from said oil column and blowing down said gas cap after said oil from said oil column is substantially depleted.

31. The method of claim 19, further comprising ceasing production of gas from said gas cap after producing said first injection fluid from said gas cap.

32. A method of producing an oil reservoir having a gas cap, an oil column, and a gas-oil contact therebetween, comprising:

simultaneously producing gas and oil from said reservoir by producing gas from said gas cap through a deviated wellbore penetrating said reservoir at said gas cap, and producing oil from said oil column through a deviated wellbore penetrating said reservoir at said oil column;

introducing a first injection fluid into said reservoir through at least one deviated wellbore penetrating said reservoir at or adjacent to said gas-oil contact of said reservoir, and displacing said first injection fluid into said gas cap to a location of said at least one deviated wellbore penetrating said reservoir at said gas cap;

ceasing production from said at least one deviated wellbore penetrating said reservoir at said gas cap when said first injection fluid reaches a location of said at least one deviated wellbore penetrating said reservoir at said gas cap; and thereafter continuing introduction of said first injection fluid into said at least one deviated wellbore penetrating said reservoir at or adjacent to said gas-oil contact and displacement of said first injection fluid into said oil column to a location of said at least one deviated wellbore penetrating said reservoir at said oil column, and continuing production from said at least one deviated wellbore penetrating said reservoir at said oil column.

* * * * *